US007938948B2

(12) United States Patent
Tsuji et al.

(10) Patent No.: US 7,938,948 B2
(45) **Date of Patent: *May 10, 2011**

(54) SILVER AND SILVER ALLOY PLATING BATH

(75) Inventors: Kiyotaka Tsuji, Kobe (JP); Tetsuji Nishikawa, Kobe (JP); Takao Takeuchi, Akashi (JP); Keigo Obata, Akashi (JP); Hidemi Nawafune, Takatsuki (JP)

(73) Assignees: Ishihara Chemical Co., Ltd., Kobe (JP); Daiwa Fine Chemicals Co., Ltd., Akashi (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/553,731

(22) Filed: Sep. 3, 2009

(65) Prior Publication Data

US 2009/0321269 A1 Dec. 31, 2009

Related U.S. Application Data

(63) Continuation of application No. 09/563,479, filed on May 2, 2000, now Pat. No. 7,628,903.

(51) Int. Cl.
*C25D 3/46* (2006.01)
*C25D 3/64* (2006.01)
*C23C 18/31* (2006.01)

(52) U.S. Cl. ..... 205/242; 205/239; 205/263; 106/1.23

(58) Field of Classification Search ..... 205/238, 205/242, 239, 263; 106/1.23
See application file for complete search history.

(56) References Cited

U.S. PATENT DOCUMENTS

| | | | | |
|---|---|---|---|---|
| 2,666,738 | A | 1/1954 | Otto | |
| 2,807,576 | A | 9/1957 | Otto | |
| 2,910,413 | A | 10/1959 | Strauss et al. | |
| 3,709,714 | A | 1/1973 | Lee | |
| 4,067,784 | A | 1/1978 | Leahy et al. | |
| 4,229,268 | A | 10/1980 | Lowery et al. | |
| 5,514,261 | A | 5/1996 | Herklotz et al. | |
| 5,759,381 | A | 6/1998 | Sakurai et al. | |
| 5,948,235 | A * | 9/1999 | Arai | 205/252 |
| 6,183,545 | B1 * | 2/2001 | Okuhama et al. | 106/1.18 |
| 6,607,653 | B1 | 8/2003 | Tsuji et al. | |
| 7,628,903 | B1 * | 12/2009 | Tsuji et al. | 205/239 |

FOREIGN PATENT DOCUMENTS

| | | | |
|---|---|---|---|
| EP | 0 666 342 | A1 | 8/1995 |
| JP | 09-143786 | A | 6/1997 |
| JP | 11-269691 | A | 10/1999 |
| WO | WO-99/41433 | | 8/1999 |

OTHER PUBLICATIONS

Banks, Naming Organic Compounds, book,1976, pp. 197, 207, 235-243, second edition, Saunders College Publishing, U.S.A.

Whitten et al., General Chemistry, book, 1981, pp. 835-839, 851-853, Saunders College Publishing, U.S.A.

* cited by examiner

*Primary Examiner* — Thao T. Tran

(74) *Attorney, Agent, or Firm* — Global IP Counselors, LLP

(57) ABSTRACT

To develop stable, non-cyanide silver and silver alloy plating baths. The present invention is a silver and silver alloy plating bath, comprises: (A) a soluble salt, comprising a silver salt or a mixture of a silver salt and a salt of a metal selected from the group consisting of tin, bismuth, cobalt, antimony, iridium, indium, lead, copper, iron, zinc, nickel, palladium, platinum, and gold; and (B) at least one aliphatic sulfide compound comprising a functionality selected from the group consisting of an ether oxygen atom, a 3-hydroxypropyl group, and a hydroxypropylene group, with the proviso that the aliphatic sulfide compound does not comprise a basic nitrogen atom.

10 Claims, No Drawings

SILVER AND SILVER ALLOY PLATING BATH

CROSS-REFERENCE TO RELATED APPLICATIONS

This is application is a continuation of U.S. patent application Ser. No. 09/563,479 filed May 2, 2000. The entire disclosure of 09/563,479 is hereby incorporated herein by reference.

BACKGROUND OF THE INVENTION

1. Field of the Invention

The present invention relates to a silver and silver alloy plating bath. The present invention provides a bath with excellent stability over an extended time. With regard to silver alloy plating baths, the present invention provides a safe, non-cyanide bath, which can reliably codeposit silver and another metal.

2. Background Information

In general, silver readily forms an insoluble salt with various compounds. As a result, it is difficult to dissolve silver in a plating bath in a manner that is stable over an extended time. Decomposition of the bath and deposition of silver occurs readily. Furthermore, silver is an electrochemically noble metal, and as a result, alloy plating with other metals is difficult. Because of this, there are limitations on the types of silver plating baths that are practical. For example, in silver or silver-tin alloy plating baths, alkaline cyanide baths, containing various cyanide compounds, are known from the prior art.

However, cyanide compounds are extremely poisonous. Because special wastewater treatment is required, not only do treatment costs rise, but because it can only be used in the alkaline range, the types of companion metals are limited when conducting silver alloy plating. In addition, with alkaline baths, there are limitations on its uses, and in practical terms, these cyanide baths do not have adequate stability.

As a result, there is a need for development of a new silver or silver alloy plating bath, which is highly safe and in which silver can be dissolved in a stable manner over a wide pH range including strongly acidic pH's.

In Japanese Laid-Open Patent Publication Number 9-143786 (henceforth referred to as prior art 1), there is disclosed a non-cyanide silver plating bath which does not contain cyanide compounds. Prior art 1 is a silver plating bath, or a silver alloy plating bath, such as a silver-tin alloy, silver-copper alloy, silver-indium alloy, and the like, containing: thioglycol, thioglycolic acid, thiodiglycolic acid, beta-thiodiglycol, dibenzothiazole disulfide, 4,4'-thiobis (3-methyl-6-tert-butylphenol), or thiourea, and the like.

In the aforementioned prior art 1, by having the plating bath contain a specified sulfur-containing compound, such as thiodiglycolic acid, beta-thiodiglycol, dibenzothiazole disulfide, or thiourea, and the like, it is stated that the plate coating has a fineness similar to that achieved by cyanide plating baths of the prior art.

However, for example, with the above silver-tin alloy plating bath containing thiodiglycolic acid or beta-thiodiglycol and the like, in reality, there is often decomposition of the bath and deposition of silver in 2-4 weeks. As an electric plating bath for long-term, continuous usage, there are practical problems in its stability over an extended time.

Furthermore, when current density conditions are changed, the rate of codeposition of silver can fluctuate. If plating is conducted at high current densities, there are problems with burning or dendrites occurring on the electrodeposition coating. In addition, there are other problems, such as the substitution deposition of silver with respect to the plating substrate of copper or copper alloy and the like (in other words, deposition due to chemical substitution action based on oxidation-reduction electric potentials), or further substitution deposition of silver on top of the deposited silver alloy coating. As a result, the silver or silver alloy plating coating does not achieve a fine and high-quality outer appearance.

Using compounds such as thiodiglycolic acid and beta-thiodiglycol and the likedisclosed in prior art 1 as the starting point, the present invention has the technical objective of developing a stable, non-cyanide silver or silver alloy plating bath which contains compounds different from these.

With regard to the stability of Lewis acid-base complexes, general and qualitative definitions for hard and soft acids and bases are known (in other words, the HSAB principle), (refer to "Application of hard, soft, acid, base definitions to organic chemistry, "Yuuki gousei kagaku vol. 33 number 11 (1975)). For example, a base with a high electronegativity, a low polarity, and with a property of strongly holding its atomic valency electron is said to be a hard base. Conversely, a base with a low electronegativity, a high polarity, and with a property of holding the atomic valency electron relatively weakly is said to be a soft base. By coordinating a hard base to a hard acid, a more stable complex is formed. Furthermore, by coordinating a soft base to a soft acid, a more stable complex is formed.

Because silver ion, which has properties of a Lewis acid, can be classified as a soft acid, the present inventors believed that a soft base, which can combine easily with a soft acid, could be effectively used in order to stabilize the silver salt in a plating bath.

In the prior art 1, sulfide compounds such as thiodiglycolic acid, beta-thiodiglycol, dibenzothiazole disulfide, 4,4'-thiobis (3-methyl-6-tert-butylphenol), and the like are used. Thiourea is known as a chelating agent of silver (also disclosed in the aforementioned prior art 1), Taking these into consideration and based on the HSAB principle, intensive research was conducted on the behavior of various soft bases in silver or various silver alloy plating baths.

SUMMARY OF THE INVENTION

As a result, it was discovered that if a silver or silver alloy plating bath contains a specified aliphatic sulfide compound, containing in the molecule at least one or more selected from the group consisting of an ether oxygen atom, a 3-hydroxypropyl group, and a hydroxypropylene group, with the proviso that it does not contain a basic nitrogen atom, there is very good stability of the bath over extended time. In addition, because silver and various metals are readily codeposited, a stable composition for a silver or silver alloy plating is obtained. From this, the present invention was completed.

In other words, invention 1 is a silver and silver alloy plating bath, comprising: (A) a soluble salt, comprising a silver salt or a mixture of a silver salt and a salt of a metal selected from the group consisting of tin, bismuth, cobalt, antimony, iridium, indium, lead, copper, iron, zinc, nickel, palladium, platinum, and gold; (B) at least one type of an aliphatic sulfide compound, containing at least one or more selected from the group consisting of an ether oxygen atom, 3-hydroxypropyl group, and hydroxypropylene group, and with the proviso that it does not contain a basic nitrogen atom.

In terms of the aforementioned invention 1, invention 2 is one in which the aliphatic sulfide compound of (B) is at least one type selected from the group consisting of aliphatic monosulfide compounds and aliphatic disulfide compounds.

In terms of the aforementioned inventions 1 or 2, invention 3 is one in which the aliphatic sulfide compound of (B) is at least one type of compound represented by a general formula (1)

$$\text{below } R_e—R_a—[(X—R_b)_L—(Y—R_c)_M(Z\text{-}R_d)_N]—R_f \quad (1)$$

(In formula (1), M represents an integer of 1-100; L and N each represent an integer of 0 or 1-100. Y represents S or S—S; X and Z each represent O, S, or S—S. $R_a$ represents a straight chain or branched alkylene of $C_1$-$C_{12}$ or a 2-hydroxypropylene. $R_b$, $R_c$, and $R_d$ represent alkylenes selected from the group consisting of methylene, ethylene, propylene, 2-hydroxypropylene, butylene, pentylene, and hexylene. With regard to X—$R_b$, Y—$R_c$, and Z-$R_d$, there are no limitations on their mutual positions, and the sequence can be random. Furthermore, when each of the bonds of X—$R_b$, Y—$R_e$, or Z-$R_e$ is to be repeated, each of the bonds can be constructed from a plurality of types of bonds. $R_e$ and $R_f$ on either end represent 1. hydrogen; or 2. halogen, cyano, formyl, carboxyl, acyl, nitro, hydroxy; or 3. alkyl, alkenyl, alkynyl, aralkyl, cycloalkyl, allyl, polycyclic cycloalkyl, acetyl, or aryl; or 4. —O-alkyl, —S-alkyl, —O-alkenyl, —O-alkynyl, —O-aralkyl, —O-cycloalkyl, —O-allyl, —O-polycyclic cycloalkyl, —O-acetyl, or —O-aryl. In the aforementioned 3-4, all of their functional groups can be substituted with halogen, cyano, formyl, alkoxy, carboxyl, acyl, nitro, or hydroxy. At least one of the aforementioned X and Z represents an oxygen atom. However, if at least one of the ends of $R_e$, $R_f$ is a functional group of the aforementioned 4 (excluding —S-alkyl) or is a propyl group with a hydroxyl substitution, or if at least one of $R_b$, $R_c$, and $R_d$ is a 2-hydroxypropylene group, this limitation is no longer required, and neither X nor Z must be an oxygen atom. If L=N=0, at least one of the ends of $R_e$, $R_f$ is a functional group of the aforementioned 4 (excluding —S-alkyl) or is a propyl group with a hydroxyl group substitution, or $R_c$ is a 2-hydroxypropylene group. If $R_b$, $R_e$, and $R_e$ are 2-hydroxypropylene groups, an oxyethylene, oxypropylene, or oxy (2-hydroxy) propylene group can be addition polymerized onto the hydroxyl group at the 2-position.)

Invention 4 is one in which the plating bath described in one of the aforementioned inventions 1-3 further contains at least one type selected from the group consisting of a surface active agent, a semi-brightening agent, a brightening agent, a smoothing agent, a conductive salt, a pH modifying agent, an auxiliary complexing agent, a suppressing complexing agent, and oxidation inhibiting agent.

DETAILED DESCRIPTION OF THE PREFERRED EMBODIMENTS

The aforementioned aliphatic sulfide compound of inventions 1-2 has a single or repeated sulfide or disulfide bond within the molecule. In addition, fundamentally, it is a compound containing at least one or more ether oxygen atoms and does not contain a basic nitrogen atom, However, instead of the ether oxygen atom, it can contain at least one or more 3-hydroxypropyl group or a hydroxypropylene group.

On the other hand, in the aforementioned prior art 1, as a concrete example of a sulfur-containing compound, dibenzothiazole disulfide (condensed heterocyclic disulfide compound) or 4,4'-thiobis (3-methyl-6-tert-butylphenol) (aromatic sulfide compound) and the like are disclosed. Furthermore, in Japanese Laid Open Patent Publication Number 10-204675 (henceforth referred to as prior art 2), tin-silver alloy plating baths containing aromatic monosulfide or disulfide compounds such as 4,4-thiodiphenol, 4,4-aminodiphenyl sulfide, thiobisthiophenol, 2,2-diaminodiphenyl disulfide, 2,2-dithiobenzoic acid, ditolyl disulfide, 2,2-dipyridyl disulfide and the like are disclosed.

However, the aforementioned various compounds disclosed in prior art 1-2 are aromatic or condensed heterocyclic sulfide compounds. They are clearly different from the aliphatic sulfide compounds of the present invention.

Next, the aliphatic sulfide compound of the present invention contains at least one or more ether oxygen atom (or a 3-hydroxypropyl group or a hydroxypropylene group) and does not contain a basic nitrogen atom. As a result, from this aspect as well, the compound of the present invention differs from the compounds of prior art 1-2. In particular, dibenzothiazole disulfide of prior art 1, or 2,2-diaminodiphenyl disulfide or 2,2-dipyridyl disulfide of prior art 2 contains basic nitrogen atom, and in addition, they do not contain an ether oxygen atom (or hydroxypropylene group). With respect to these points, they are completely different from the sulfide compounds of the present invention.

Furthermore, as described in the beginning, as the sulfur containing compound, prior art 1 discloses monosulfide compounds such as thiodiglycolic acid ($HOOCCH_2SCH_2COOH$), or beta-thiodiglycol ($HOCH_2CH_2SCH_2CH_2OH$). However, although these monosulfide compounds are aliphatic like the sulfide compounds of the present invention, because they do not contain any ether oxygen atoms (or 1-hydroxypropyl group or hydroxypropylene group), they are clearly different from the sulfide compounds of the present invention.

As described above, the aliphatic sulfide compound of the present invention can be represented by the general formula (1).

Of the atomic groups X—$R_b$, Y—$R_c$, and Z-$R_d$ in the aforementioned formula (1), only Y represents S or S—S. X and Z represent O, S or S—S.

In the aforementioned formula (1), integers L and N can be zero, but integer M is one or greater and is never zero. Therefore, the compound of the present invention always contains a sulfide or disulfide bond represented by (Y—$R_c$).

Furthermore, if the aforementioned X or Z is an oxygen atom, because the aforementioned $R_b$ and $R_d$ are each a $C_1$-$C_6$ alkylene (however, with $C_3$ alkylene in particular, this includes both propylene group and 2-hydroxypropylene group), X—$R_b$ or Z-$R_d$ represents an oxyalkylene.

With regard to the aforementioned atomic groups of X—$R_b$, Y—$R_c$, and Z-$R_c$, there are no limitations on their mutual positions, and the sequence can be random. For example, the sequence for the atomic groups of Y—$R_c$, and X—$R_b$ can be reversed, and the construction can be represented by $R_e—R_a—[(Y—R_c)_M—(X—R_b)_L\text{-}(Z\text{-}R_d)N]—R_f$. Furthermore, if integers L, M, and N are 1 or greater, and each of the bonds of X—$R_b$, Y—$R_c$, or Z-$R_d$ are repeated, each bond can be constructed from several types of bonds. For example, when X is an oxygen atom, X—$R_b$ can be a mix of oxyethylene and oxypropylene, In this case, $(X—R_b)_L$ takes on the construction of $$[(O—C_2H_4)_{L1}—(O—C_3H_6)_{L1}] \text{ (where } L_1+L_2=L)$$

The functional groups $R_e$, $R_f$ at both ends of the aforementioned general formula (1) represents one of the following 1-3.1. Hydrogen 2. Halogen, cyano, formyl, carboxyl, acyl, nitro, hydroxy. 3. Alkyl, alkenyl, alkynyl, aralkyl, cycloalkyl, allyl (—$CH_2CH{=}CH_2$), polycyclicycloalkyl, acetyl, or aryl (for example, $C_6H_5$ (benzene ring)). 4. —O-alkyl, —S-alkyl, —O-alkenyl, —O-alkynyl, —O-aralkyl, —O-cycloallyl, —O-allyl (—O—$CH_2CH{=}CH_2$), —O-polycyclic cycloalkyl, —O-acetyl or —O-aryl (for example —O—$C_5H_6$, (benzene ring)).

In the aforementioned 3, 4, all of the functional groups of alkyl, alkenyl, alkynyl, and the like can each be substituted with halogen, cyano, formyl, alkoxy, carboxyl, acyl, nitro, or hydroxy.

Furthermore, atomic group $R_a$, represents a $C_1$-$C_{12}$ straight chain or branched alkylene such as methylene group or ethylene group and the like, or it represents 2-hydroxypropylene.

In the aforementioned general formula (1), as indicated by the following formula (2), at least one of X or Z is an oxygen atom. Therefore, at least one of X—$R_b$ or Z-$R_d$ represents an oxyalkylene.

$$R_e—R_e—[(O—R_b)_L—(S—R_c)_M—(S—R_d)_N]—R_f \quad (2)$$

However, with regard to the aforementioned functional groups $R_e$, $R_f$ on both ends, if at least one of them is a functional group of the aforementioned 4 (excluding S-alkyl) or is a propyl group with a hydroxyl group substitution, or else, if at least one of $R_a$, $R_b$, and $R_c$ is a 2-hydroxypropylene group, this limitation does not apply. As shown in the following formulas (3a)-(3c), neither X nor Z are oxygen atoms, and they can be S or S—S.

$$H—R_a—[(S—R_b)_L—(S—R_c)_M—(S—R_d)_N]—OC_2H_5 \quad (3a)$$

$$H—R_a—[(S—R_b)_L—(S—R_c)_M—(S—R_d)_N]—CH_2CH(OH)CH_2—H \quad (3b)$$

$$C_2H_5O—R_a—[(S—CH_2CH(OH)CH_2)_L—(S—R_c)_M—(S—R_d)_N]—CH_3 \quad (3c)$$

The above formula (3a) is a compound containing an ether oxygen atom, the above formula (3b) is a compound containing a hydroxypropylene group, the above formula (3c) is a compound containing both.

Furthermore, as indicated by the following formulas (4) and (5), if L=N=0, at least one of the functional groups $R_e$, $R_f$ on either end is a functional group of the aforementioned 4 (excluding S-alkyl) or is a propyl group with a hydroxyl group substitution, or else, $R_a$ or $R_c$ is a 2-hydroxypropylene group.

$$C_2H_5O—CH_2CH_2—(S—CH_2CH_2)_M—CH_2CH(OH)CH_2—H \quad (4)$$

$$HO—CH_2CH_2—(S—S—CH_2CH(OH)CH_2)_M—CH_3 \quad (5)$$

By following the above conditions, with the aforementioned general formula (1), the aliphatic sulfide of the present invention always contains an ether oxygen atom, a 3-hydroxypropyl group, or a hydroxypropylene group.

In addition, concrete examples of the aliphatic sulfide compound of the present invention will be described below. Among these compounds, thiobis (diethyleneglycol), thiodiglycol bis(carboxymethyl)ether, diethyleneglycol monomethyl thioether, and the like are compounds containing ether oxygen atoms; 3,3'-thiodipropanol, and the like are compounds containing a 3-hydroxypropyl group; thiodiglycerin, 4,8,12-trithiapentadecane-1,2,6,10,14,15-hexaol, and the like are compounds containing ahydroxypropylene group; thiobis (triglycerin), dithiobis (decaglycerol), and the like are compounds containing both an ether oxygen atom and a hydroxypropylene group.

Furthermore, as indicated by the following formula (6), if the above $R_b$, $R_c$, and $R_d$ are 2-hydroxypropylene groups, then oxyethylene, oxypropylene, or oxy (2-hydroxy)propylene can be addition polymerized to the hydroxyl group at its 2-position.

$$\begin{array}{l} H—(OCH_2CH_2)_{10}—OCH_2CHCH_2S—CH_2CHCH_2O—(CH_2CH_2O)_{10}—H \\ \qquad\qquad\qquad\qquad\quad | \qquad\qquad\qquad\qquad\quad | \\ \quad H—(OCH_2CH_2)_{10}—O \qquad\qquad\qquad\qquad O—(CH_2CH_2O)_{10}—H \end{array} \quad (6)$$

Aliphatic sulfide compounds of the present invention which are represented by concrete structural formulas will be described following the aforementioned general formula (1).

For example, H—$(OE)_2$-S-$(EO)_2$—H (where E represents ethylene) can be rewritten as HO—$(CH_2CH_2)$—(OE)-(S-E)-(OE)-OH. Comparing it with the aforementioned general formula (1), Y—$R_e$ corresponds to (S-E), X—$R_b$ corresponds to oxyethylene (OE), Z-$R_e$ corresponds to oxyethylene, $R_a$ corresponds to $CH_2CH_2$, and $R_e$ and $R_f$ both correspond to OH. L, M, and N are all 1.

In addition, for example, $PhCH_2$—$OCH_2CH(CH_3)$—S—$C_4H_8$—S-$(EO)_{80}$—$(CH_2CH(CH_3)O)_{10}$—H can be rewritten as $PhCH_2$—OP—{(S—B)—(S-E)}-{$(OE)_{79}$-$(OP)_{10}$}—OH (where P is propylene, B is butylene, Ph is a phenyl group). Comparing it with the aforementioned general formula (1), Y—$R_c$ corresponds to a composite of (S—B) and (S-E), X—$R_b$ corresponds to oxypropylene (OP), Z-$R_d$ corresponds to a composite of oxyethylene and oxypropylene, $R_e$ corresponds to $CH_2$, $R_e$ corresponds to a phenyl group, and $R_f$ corresponds to OH. L is 1, M is 2, and N is 89.

Incidentally, with the above two types of aliphatic sulfide compounds, the former has two ether oxygen atoms, and the latter has ninety ether oxygen atoms. They do not contain a basic nitrogen atom.

The following compounds are concrete examples of the aforementioned aliphatic sulfide compounds.

(1) thiobis(diethyleneglycol), represented by H—$(OCH_2CH_2)_2$—S—$(CH_2CH_2O)_2$—H
(2) thiobis(hexaethyleneglycol)
(3) thiobis(pentadecaglycerol), represented by H—$(OCH_2CH(OH)CH_2)_{15}$—S—$(CH_2CH(OH)CH_2O)_{15}$—H
(4) thiobis(icosaethyleneglycol), represented by H—$(OCH_2CH_2)_{20}$—S—$(CH_2CH_2O)_{20}$—H
(5) thiobis(pentacontaethyleneglycol)
(6) 4,10-dioxa-7-thiatridecane-2,12-diol, represented by HO—$CH(CH_3)CH_2$—$OCH_2CH_2$—$SCH_2CH_2$—$OCH_2CH(CH_3)$—OH
(7) thiodiglycerin represented by $HOCH_2CH(OH)CH_2$—S—$CH_2CH(OH)CH_2OH$
(8) thiobis(triglycerin), represented by H—$(OCH_2CH(OH)CH_2)_3$—S—$(CH_2CH(OH)CH_2O)_3$—H
(9) 2,2'-thiodibutanol bis(octaethyleneglycol pentaglycerol) ether, represented by H—$(OCH_2CH(OH)CH_2)_5$—$(OCH_2CH_2)_8$—$OC_4H_8$—$SOC_4H_8$—O—$(CH_2CH_2O)_8$—$(CH_2CH(OH)CH_2O)_5$—H
(10) thiobis(octaethyleneglycol) bis(2-chloroethyl)ether, represented by Cl—$CH_2CH_2CH_2$—$(OCH_2CH_2)_8$—S—$(CH_2CH_2O)_8$—$CH_2CH_2CH_2$—Cl
(11) thiobis(decaethyleneglycol) bis(carboxymethyl)ether
(12) thiobis(dodecaethyleneglycol) bis(2-nitroethyl)ether
(13) thiodiglycol bis(carboxymethyl)ether, represented by $HOOCCH_2OCH_2CH_2$—S—$CH_2CH_2OCH_2COOH$
(14) dithiodiglycol bis(carboxymethyl)ether, represented by $HOOCCH_2OCH_2CH_2$—S—S—$CH_2OCH_2COOH$
(15) thiobis(dodecaethyleneglycol), represented by H—$(OCH_2CH_2)_{12}$—S—$(CH_2CH_2O)_{12}$—H
(16) dithiobis(hentetracontaethyleneglycol), represented by H—$(OCH_2CH_2)_{41}$—S—S—$(CH_2CH_2O)_{41}$—H
(17) dithiobis(icosaethyleneglycol pentapropyleneglycol), represented by H—$(OC_3H_6)_5$—$(OC_2H_4)_{20}$—S—S—$(OC_2H_4)_{20}$—$(OC_3H_6)_5$—H
(18) dithiobis(triglycerol), represented by H—$(OCH_2CH(OH)CH_2)_3$—S—S—$(CH_2CH(OH)CH_2O)_3$—H
(19) dithiobis(decaglycerol)
(20) 3,6-dithiaoctane-1,8-diol, represented by $HOCH_2CH_2S$—$CH_2CH_2$—$SCH_2CH_2OH$

(21) 1,3-propanedithiol bis(decaethyleneglycol) thioether, represented by $H—(OC_2H_4)_{10}—S—C_3H_6—S—(OC_2H_4)_{10}—H$

(22) 1,4-butanedithiol bis(pentaderaglycerol) thioether, represented by $H—(OCH_2CH(OH)CH_2)C_{15}—S—C_4H_8—S—(CH_2CH(OH)CH_2O)_{15}—H$

(23) 1,3-dithioglycerol bis(pentaethyleneglycol) thioether, represented by $H—(OCH_2\ CH_2)_5—SCH_2CH(OH)CH_2S—(CH_2CH_2O)_5—H$

(24) 1,2-ethanedithiol bis(penta(1-ethyl)ethyleneglycol) thioether, represented by $H—(OCH(C_2H_5)CH_2)_5—SC_2H_4S—(CH_2CH(C_2H_5)O)_5—H$

(25) 1,3-dithioglycerol bis(di(1-ethyl)ethyleneglycol) thioether, represented by $H—(OCH(CH_3)CH_2)_2—SCH_2CH(CH)CH_2S—(CH_2CH(CH_3)O)_2—H$

(26) 2-mercaptoethylsulfide bis(hexatriacontaethyleneglycol), represented by $H—(OC_2H_4)_{18}—SC_2H_4—SC_2H_4—S—(C_2H_4O)_{18}—H$

(27) 2-mercaptoethylsulfide bis(icosaethyleneglycol) dimethylether, represented by $CH_3—(OC_2H_4)_{10}—SC_2H_4—SC_2H_4—S—(C_2H_4O)_{10}—CH_3$

(28) 2-mercaptoethylether bis(diethyleneglycol), represented by $H—(OC_2H_4)_2—S—CH_2CH_2OCH_2CH_2—S—(C_2H_4O)_2—H$

(29) thiodiglycerol tetra(decaethyleneglycol) ether, represented by the above formula (6)

(30) diethyleneglycol monomethylthioether, represented by $CH_3—S—(CH_2CH_2O)_2—H$

(31) decaglycerol mono(6-methylthiohexyl)thioether, represented by $CH_3—S—C_6H_{12}—S—(CH_2CH(OH)CH_2O)_{10}—H$

(32) 2-mercaptoethylsulfide-omega-{(2-bromoethyl) icosaethyleneglycol}thioether-omega'-{(2-bromoethyl)hectaethyleneglycol}thioether, represented by $BrCH_2CH_2—(OCH_2CH_2)_{20}—(S—CH_2CH_3)_3—(OCH_2CH_2)_{100}—OCH_2CH_2Br$

(33) 1,4-butanediol-omega-{(2-benzyloxy-1-methyl) ethyl}thioether-omega'-(decapropyleneglycol octacontaethyleneglycol)thioether, represented by $PhCH_2OCH_2CH(CH_3)—S—C_4H_8—S—(CH_2CH_2O)_{80}—(CH_2CH(CH_3)O)_{10}—H$

(34) dithiobis(icosaethyleneglycol) bis(2-methylthioethyl)ether, represented by $CH_3—S—CH_2CH_2—(OCH_2CH_2)_{20}—S—S—(CH_2CH_2O)_{20}—CH_2CH_2S—CH_3$

(35) 1,2-ethanediol-omega-(4-methoxybenzyl)thioether-omega'-(pentacontaethyleneglycol)thioether, represented by $CH_3O\text{-}Ph\text{-}CH_2S—CH_2CH_2—(CH_2CH_2O)_{50}—H$

(36) triacontaethyleneglycol mono(4-cyanobenzyl)thioether, represented by $NC\text{-}Ph\text{-}CH_2S—(CH_2CH_2O)_{30}—H$

(37) thiobis(pentadecaethyleneglycol) bisallylether, represented by $CH_2{=}CHCH_2—(OCH_2CH_2)_{15}—S—(CH_2CH_2O)_{15}—CH_2CH{=}CH_2$

(38) tricosaethyleneglycol mono(4-formylphenetyl)thioether, represented by $OHC\text{-}Ph\text{-}CH_2CH_2—S—(CH_2CH_2O)_{23}—H$

(39) pentadecaethyleneglycol mono{(acetylmethyl) thioethyl}thioether, represented by $CH_3COCH_2—S—CH_2CH_2—S—(CH_2CH_2O)_{15}—H$

(40) 1,2-ethanediol-omega-(glycidyl)thioether-omega'-icosaethyleneglycol thioether, represented by the following formula (7)

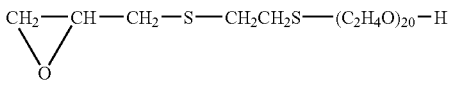

(7)

(41) octadecaethyleneglycol bis(2-methylthioethyl)ether, represented by $CH_3—S—CH_2\ CH_2CO—(CH_2CH_2O)_{18}—CH_2CH_2S—CH_3$

(42) hexadecaethyleneglycol mono(2-methylthioethyl) thioether, represented by $CH_3—S—CH_2CH_2—S—(CH_2CH_2O)_{16}—H$

(43) icosaethyleneglycol monomethylthioether, represented by $CH_3—S—(CH_2CH_2O)_{20}—H$

(44) undecaethyleneglycol di(n-propyl)thioether, represented by $C_3C_7—S—(CH_2CH_2O)_{10}—CH_2CH_2S—C_3H_7$

(45) dodecaethyleneglycol bis(2-hydroxyethyl)thioether, represented by $HOCH_2CH_2S—(CH_2CH_2O)_{11}—CH_2CH_2S—CH_2CH_2OH$

(46) undecaethyleneglycol dimethylthioether

(47) pentatriacontaethyleneglycol mono(2-n-butyldithioethyl)dithioether, represented by $C_4H_9—S—S—CH_2CH_2—S—S—(CH_2CH_2O)_{35}—H$

(48) 4,8,12-trithiapentadecane-1,2,6,10,14,15-hexaol, represented by $HOCH_2CH(OH)CH_2—S—CH_2CH(OH)CH_2—S—CH_2CH(OH)CH_2—S—CH_2CH(OH)CH_2OH$

(49) icosaglycerol mono(2-ethylthioethyl)thioether, represented by $C_2H_5—S—CH_2CH_2—S—(CH_2CH(OH)CH_2O)_{20}—H$

(50) triacontaethyleneglycol mono(2-methylthioethyl) thioether, represented by $CH_3—S—CH_2CH_2—S—(C_2H_4O)_{30}—H$

(51) dithiobis(icosaethyleneglycol)dibenzylether, represented by $Ph\text{-}CH_2—(OC_2H_4)_{20}—S—S\ (C_2H_4O)_{20}—CH_2\text{-}Ph$

(52) tridecaethyleneglycol monomethylthioether, represented by $CH_3—S—(CH_2CH_2O)_{10}—H$

(53) hexadecaethyleneglycol dimethylthioether, represented by $CH_3—S—(CH_2CH_2O)_{15}—CH_2CH_2S—CH_3$

(54) 1,2-ethanedithiol bis(icosaethyleneglycol)thioether, represented by $H—(OCH_2CH_2)_{20}—S—CH_2CH_2—S—(CH_2CH_2O)_{20}—H$

(55) dithio bis(pentadecaethyleneglycol), represented by $H—(OCH_2CH_2)_{15}—S—S—(CH_2CH_2O)_{15}—H$

(56) 3,3'-thiodipropanol, represented by $HO—CH_2CH_2CH_2—S—CH_2CH_2CH_2—OH$

The above aliphatic sulfide compounds can be used singly or jointly. The overall concentration of these compounds with respect to the plating bath can be increased or decreased depending on the silver concentration in the plating bath. Stated concretely, the concentration is 0.0001-5 mol/L, preferably 0.001-2 mol/L.

The present invention relates to silver plating baths and silver alloy plating baths. As described above, this silver alloy is an alloy of silver and a metal selected from the group consisting of tin, bismuth, indium, lead, copper, zinc, nickel, palladium, platinum, and gold. Stated concretely, starting with two component silver alloys of silver-tin, silver-bismuth, silver-indium, silver-lead, silver-copper, silver-zinc, silver-nickel, silver-palladium, silver-platinum, silver-gold, and the like, it also includes three component silver alloys, such as silver-tin-gold, silver-tin-palladium, silver-tin-nickel, silver-tin-copper, silver-copper-indium, and the like.

With three component systems, such as silver-tin-palladium, silver-tin-nickel, and the like, by having the plating bath contain minute amounts (for example 200-1000 mg/L) of palladium salt or nickel salt, a silver-tin alloy containing palladium or nickel can be obtained.

As the silver salt, any soluble salt can be used, such as silver sulfate, silver sulfite, silver carbonate, silver sulfosuccinate, silver nitrate, silver citrate, silver tartrate, silver gluconate, silver oxalate, silver oxide, and the like. However, as will be described later, salts with acids (particularly organic sulfonic acids) are preferred (such as silver methanesulfonate, silver ethane sulfonate, silver 2-propanol sulfonate, silver fluoborate, and the like).

The salts of the aforementioned metals which generate alloys with silver can be any soluble salt that generates various metal ions, such as $Sn^{2+}$, $Sn^{4+}$, $SnO_3^{2-}$, $Bi^{3+}$, $In^{3+}$, $pb^{2+}$, $Cu^{2+}$, $Cu^{+}$, $Zn^{2+}$, $Ni^{2+}$, $Pd^{2+}$, $Pt^{2+}$, $Pt^{4+}$, $Au^{+}$, $Au^{3+}$, and the like. The concrete examples are as follows. Among these, salts with acids (particularly organic sulfonic acids) which are described later are preferred.

(1) oxides: bismuth oxide, indium oxide, zinc oxide, copper (II) oxide, copper (I) oxide, nickel oxide, tin (I) oxide, tin (II) oxide, and the like.

(2) halides: bismuth chloride, bismuth bromide, indium chloride, indium iodide, lead chloride, zinc chloride, zinc bromide, copper (I) chloride, copper (II) chloride, nickel chloride, palladium chloride, tin (I) chloride, tin (II) chloride, and the like, In the presence of a halogen ion, silver ions will precipitate as a sliver halide. However, in the plating bath of the present invention, even if the above halides are added, if it is a small amount, there will be no precipitation of silver halide.

(3) salts with inorganic acids or organic acids, etc.: bismuth nitrate, bismuth sulfate, indium sulfate, copper (II) sulfate, tin (I) sulfate, tin (I) fluoborate, zinc sulfate, nickel acetate, nickel sulfate, palladium sulfate, bismuth methane sulfonate, zinc methanesulfonate, tin (I) methane sulfonate, tin (I) ethane sulfonate, tin (I) 2-propanol sulfonate, lead methane sulfonate, lead p-phenol sulfonate, copper (II) p-phenol sulfonate, nickelmethane sulfonate, palladium methane sulfonate, platinum ethane sulfonate, gold 2-propanol sulfonate, sodium stannate, potassium stannate, and the like.

The above soluble salts of silver and the specified metals can be used singly or jointly, The total concentration of these metals (conversion addition amount as metal) is 0.01-200 g/L, preferably 0.1-100 g/L.

The plating bath of the present invention can be an acid bath, neutral bath or alkaline bath. However, with an alkaline bath, there is a tendency for there to be limitations on its usage. Therefore, acid baths and neutral baths are preferred.

With an acid bath, organic acids, such as organic sulfonic acids or aliphatic carboxylic acids, are preferred. Organic sulfonic acids, such as alkane sulfonic acids; alkanol sulfonic acids, and the like, have a relatively gentle reaction in the plating bath, and the waste water treatment is easy. However, inorganic acids, such as sulfuric acid, hydrofluoboric acid, hydrofluosilicic acid, perchloric acid, and the like, can also be selected.

Furthermore, with alkaline baths, sodium hydroxide, potassium hydroxide, ammonia, and the like can be used.

The above acids or alkalis can be used singly or used jointly. The addition amount is generally 0.1-500 g/L, and preferably 10-250 g/L.

For the above alkane sulfonic acids, ones represented by chemical formula $C_nH_{2n+1}SO_3H$ (for example, n=1-1) can be used. Stated concretely, examples include methane sulfonic acid, ethane sulfonic acid, 1-propane sulfonic acid, 2-propane sulfonic acid, 1-butane sulfonic acid, 2-butane sulfonic acid, pentane sulfonic acid, hexanesulfonic acid, decane sulfonic acid, dodecane sulfonic acid, and the like.

For the above alkanol sulfonic acid, ones represented by chemical formula $C_mH_{2m+1}$—CH(OH)—$C_pH_{2p}$—$SO_3H$ (for example, m=0-2, p=1-10) can be used. Stated concretely, examples include 2-hydroxyethane-1-sulfonic acid, 2-hydroxypropane-1-sulfonic acid, 2-hydroxybutane-1-sulfonic acid, 2-hydroxypentane-1-sulfonic acid, as well as 1-hydroxypropane-2-sulfonic acid, 3-hydroxypropane-1-sulfonic acid, 4-hydroxybutane-1-sulfonic acid, 2-hydroxyhexane-1-sulfonic acid, 2-hydroxydecane-1-sulfonic acid, 2-hydroxydodecane-1-sulfonic acid, and the like.

For the above aliphatic carboxylic acid, in general, carboxylic acids with a carbon number of 1-6 can be used, Stated concretely, examples include acetic acid, propionic acid, butyric acid, citric acid, tartaric acid, gluconic acid, sulfosuccinic acid, and the like.

Other than the various components described above, additives, such as surface active agents, brightening agents, semi-brightening agents, smoothing agents, pH modifying agents, buffering agents, auxiliary complexing agent, suppressing complexing agent, oxidation inhibiting agents, conductive salts, and the like, can be added to the plating bath of the present invention depending on the objective.

As the above surface active agent, various examples of surface active agents, which are non-ionic, anionic, cationic, or amphoteric, can be given. These various active agents can be used singly or be used jointly. Its addition amount is 0.01-100 g/L, and preferably 0.1-50 g/L.

Concrete examples of non-ionic surface active agents include ones in which 2-300 moles of ethylene oxide (EO) and/or propylene oxide (PO) are addition condensed with the following: $C_1$-$C_{20}$ alkanols, phenols, naphthols, bisphenols, $C_1$-$C_{25}$ alkylphenols, arylalkylphenols, $C_1$-$C_{25}$ alkylnaphthols, $C_1$-$C_{25}$ alkoxylated phosphoric acids (salt), sorbitan esters, styrenated phenols, polyalkyleneglycols, $C_1$-$C_{22}$ aliphatic amines, $C_1$-$C_{22}$aliphatic amides; or $C_1$-$C_{25}$ alkoxylated phosphoric acids (salts), and the like.

For the $C_1$-$C_{20}$ alkanol which is addition condensed with ethylene oxide (EO) and/or propylene oxide (PO), examples include octanol, decanol, lauryl alcohol, tetradecanol, hexadecanol, stearyl alcohol, eicosanol, cetyl alcohol, oleyl alcohol, docosanol, and the like.

Similarly, as the bisphenols, examples include bisphenol A, bisphenol B, bisphenol F, and the like.

For the $C_1$-$C_{25}$ alkylphenols, examples include mono-, di-, or trialkyl substitution phenols, such as p-methylphenol, p-butylphenol, p-isooctylphenol, p-nonylphenol, p-hexylphenol, 2,4-dibutylphenol, 2,4,6-tributylphenol, dinonylphenol, p-dodecylphenol, p-laurylphenol, p-stearylphenol, and the like.

For the arylalkylphenols, examples include 2-phenylisopropylphenol, cumylphenols, and the like.

For the alkyl group of the $C_1$-$C_{25}$ alkylnaphthols, examples include methyl, ethyl, propyl, butylhexyl, octyl, decyl, dodecyl, octadecyl, and the like. The naphthalene nucleus can be at any position.

For the $C_1$-$C_{25}$ alkoxylated phosphoric acid (salt), it is represented by the following general formula (a).

(a)

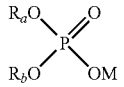

(In formula (a), $R_a$ and $R_b$ are the same or different $C_1$-$C_{25}$ alkyls. However, one can be just an H. M represents an H or an alkaline metal.

For the sorbitan ester, examples include mono-, di-, or triesterification of 1,4-, 1,5-, or 3,6-sorbitan, for example, sorbitan monolaurate, sorbitan monopalmitate, sorbitandistearate, sorbitan dioleate, sorbitan mixed fatty acid ester, and the like.

For the $C_1$-$C_{22}$ aliphatic amine, examples include saturated and unsaturated fatty acid amines, such as propyl amine, butyl amine, hexyl amine, octyl amine, decyl amine, lauryl amine, myristyl amine, stearyl amine, oleyl amine, beef tallow amine, ethylenediamine, propylene diamine, and the like.

For the $C_1$-$C_{22}$ aliphatic amide, examples include amides such as propionic acid, butyric acid, caprylic acid, capric acid, lauric acid, myristylic acid, plamitic acid, stearicacid, oleyic acid, behenic acid, coconut oil fatty acid, beef tallow fatty acid, and the like.

Furthermore, for the above non-ionic surface active agent, amine oxides represented by the following formula and the like can be used.

$R_1N(R_2)_2$—O(in the above formula, $R_1$ represents a $C_5$-$C_{25}$ alkyl or $RCONHR_3$ ($R_3$ is a $C_1$-$C_5$ alkylene), $R_2$ is the same or a different $C_1$-$C_5$ alkyl.)

Two or more of the above non-ionic surface active agents can be mixed. The addition amount to the plating bath is generally 0.05-100 g/L, preferably 0.1-50 g/L.

For the above cationic surface active agent, examples include a quaternary ammonium salt represented by the following general formula (b):

(b)

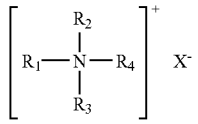

(In formula (b), X represents a halogen, hydroxy, $C_1$-$C_5$ alkane sulfonic acid, or sulfuric acid; $R_1$, $R_2$, and $R_3$ represent the same or different $C_1$-$C_{20}$ alkyls, $R_4$ represents a $C_1$-$C_{10}$alkyl or benzyl) or, a pyridinium salt represented by the following general formula (c), and the like.

(c)

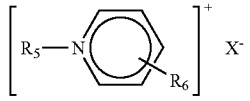

(In the formula (c), X represents a halogen, hydroxy, $C_1$-$C_5$ alkane sulfonic acid, or sulfuric acid; $R_5$ represents a $C_1$-$C_{20}$ alkyl, $R_6$ represents H or a $C_1$-$C_{10}$ alkyl.)

Examples of salt forms of cationic surface active agents include lauryltrimethylammonium salt, stearyltrimethyl ammonium salt, lauryldimethylethyl ammonium salt, octadecyldimethylethyl ammonium salt, dimethylbenzyllauryl ammonium salt, cetyldimethylbenzyl ammonium salt, octadecyldimethylbenzyl ammonium salt, trimethylbenzyl ammonium salt, triethylbenzyl ammonium salt, hexadecyl pyridmiumsalt, lauryl pyridinium salt, dodecyl pyridinium salt, stearylamine acetate, laurylamineacetate, octadecylamine acetate, and the like.

For the above anionic surface active agent, examples include alkyl sulfate, polyoxyethylenealkylether sulfate, polyoxyethylene alkylphenylether sulfate, alkylbenzene sulfonate, (mono, di, tri) alkylnaphthalene sulfonate, and the like. Examples of alkyl sulfates include sodium lauryl sulfate, sodium oleyl sulfate, and the like. Examples of polyoxyethylenealkylether sulfates include sodium polyoxyethylene (EO12) nonylether sulfate, sodium polyoxyethylene (EO15) dodecylether sulfate, and the like. Examples of polyoxyethylene alkylphenylether sulfates include polyoxyethylene (EO15) nonylphenylether sulfates, and the like. Examples of alkylbenzene sulfonates include sodium dodecylbenzene sulfonate, and the like. Examples of (mono, di, tri)alkylnaphthalene sulfonates include sodium dibutylnaphthalene sulfonate, and the like.

For the above amphoteric surface active agents, examples include carboxybetaine, imidazoline betaine, sulfobetaine, aminocarboxylic acid, and the like. In addition, a sulfation or sulfonation addition product of ethylene oxide and/or a condensation product between propylene oxide and alkyl amine or diamine can also be used.

The above carboxybetaine is represented by the following general formula (d).

(d)

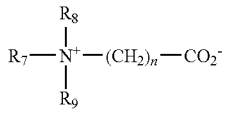

(In formula (d), $R_7$ represents a $C_1$-$C_{20}$ alkyl; $R_8$ and $R_9$ represent the same or different $C_1$-$C_5$ alkyl; n represents an integer of 1-3.)

The above imidazoline betaine is represented by the following general formula (e).

(e)

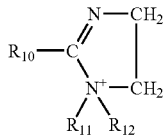

(In formula (e), $R_{10}$ represents a $C_1$-$C_{20}$ alkyl; $R_{11}$, represents $(CH_2)_mOH$ or $(CH_2)_mOCH_2C0_2^-$; $R_{12}$ represents $(CH_2)_n C0_2^-$, $(CH_2)_nS0_3^-$, $CH(OH)CH_2SO_3^-$; m and n represent integers of 1-4.)

Representative carboxybetaine or imidazoline betaine include lauryldimethylaminoacetate betaine, myristyldimethylaminoacetate betaine, stearyldimethylaminoacetate betaine, coconut oil fatty acidamidopropyldimethylaminoacetate betaine, 2-undecyl-1-carboxymethyl-1-hydroxyethylimidazolinium betaine, 2-octyl-1-carboxymethyl-1-carboxyethylimidazolinium betaine, and the like. Examples of sulfation or sulfonation addition product include sulfation addition product of ethoxylated alkylamine, sodium salt of sulfonated lauric acid derivative, and the like.

Examples of the above sulfobetaine include coconut oil fatty acidamidopropyldimethylammonium-2-hydroxypropane sulfonic acid, sodium N-cocoylmethyltaurine, sodium N-palmitoyl methyltaurine, and the like.

Examples of aminocarboxylic acids include dioctylaminoethylglycine, N-laurylaminopropionic acid, sodium octyl di(aminoethyl)glycine, and the like.

The above brightening agent or semi-brightening agent is mainly for improving the brightness or semi-brightness of the plate coating. The smoothing agent is mainly for improving the smoothness, fineness, outer appearance, and the like of the plate coating. However, these brightening agents, semi-brightening agents, or smoothing agents may be conceptually partially redundant. Irrespective of the name, any compound can be used as long as it exhibits these actions.

Concrete examples of the above brightening agents include beta-naphthol, beta-naphthol-6-sulfonic acid, beta-naphthalene sulfonic acid, m-chlorobenzaldehyde, p-nitrobenzaldehyde, p-hydroxybenzaldehyde, (o-, p-)methoxybenzaldehyde, vanillin, (2,4-, 2,6-) dichlorobenzaldehyde, (o-, p-)chlorobenzaldehyde, 1-naphtaldehyde, 2-naphthaldehyde, 2(4)-hydroxy-1-naphthaldehyde, 2(4)-chloro-1-naphthaldehyde, 2(3)-thiophenecarboxyaldehyde, 2(3)-furaldehyde, 3-indolecarboxyaldehyde, salicylaldehyde, o-phthaldehyde, formaldehyde, acetoaldehyde, paraldehyde, butylaldehyde, isobutylaldehyde, propionaldehyde, n-valeraldehyde, acrolein, crotonaldehyde, glyoxal, aldol, succindialdehyde, capronaldehyde, isovaleraldehyde, allylaldehyde, glutaraldehyde, 1-benzylidene-7-heptanal, 2,4-hexadienal, cinnamaldehyde, benzylcrotonaldehyde, amine-aldehyde condensate, mesityl oxide, isophorone, diacetyl, hexanedione-3,4, acetylacetone, 3-chlorobenzylideneacetone, sub. pyridirideneacetone, sub. furfurylideneacetone, sub, thenylideneacetone, 4-(1-naphthyl)-3-butene-2-one, 4-(2-furil)-3-butene-2-one, 4-(2-thiophenyl)-3-butene-2-one, curcumin, benzylideneacetylacetone, benzalacetone, acetophenone, (2,4-, 3,4-)dichloroacetophenone, benzylideneacetophenone, 2-cinnamylthiophene, 2-(omega-benzoyl) vinylfuran, vinylphenylketone, acrylic acid, methacrylic acid, ethacrylic acid, ethyl acrylate, methyl methacrylate, butyl methacrylate, crotonic acid, propylene-1,3-dicarboxylic acid, cinnamic acid, (o-, m-, p-) toluidine, (o-, p-) aminoaniline, aniline, (o-, p-) chloroaniline, (2,5-, 3,4-) chloromethylaniline, N-monomethylaniline, 4,4'-diaminodiphenylmethane, N-phenyl-(alpha-, beta-)naphthylamine, methylbenztriazole, 1,2,3,-triazine, 1,2,4-triazine, 1,3,5-triazine, 1,2,3-benztriazine, imidazole, 2-vinylpyridine, indole, quinoline, reaction product of monoethanolamine and o-vanillin, polyvinyl alcohol, catechol, hydroquinone, resorcin, polyethylene imine, disodiumethylenediamine tetraacetate, polyvinylpyrrolidone, and the like.

Furthermore, for the semi-brightening agent, examples include gelatin, polypeptone, as well as compounds represented by the following general formula (f)-(i).

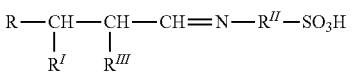

(f)

(In formula (1, R is hydrogen, alkyl group ($C_1$-$C_4$) or phenyl group; $R^I$ is hydrogen, hydroxyl group, or if it does not exist, $R^{II}$ is an alkylene group ($C_1$-$C_4$), phenylene group or benzyl group, $R^{III}$ is a hydrogen or alkyl group ($C_0$-$C_4$).)

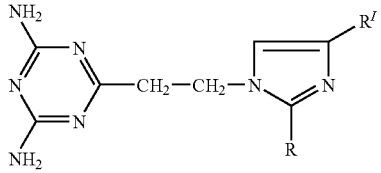

(g)

(In formula (g), R, $R^I$ is an alkyl group ($C_1$-$C_{18}$).)

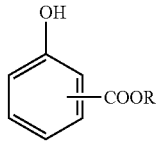

(h)

(In formula (h), R is hydrogen, alkyl group ($C_1$-$C_4$) or phenyl group.)

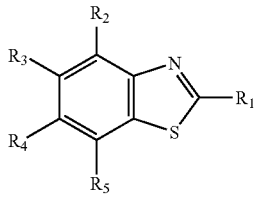

(i)

(In formula (1), $R_1$, $R_2$, $R_3$, $R_4$, and $R_5$ can be the same or different and are defined as (1) H, (2) —SH, (3) —OH, (4) OR (R is a $C_1$-$C_6$ alkyl group in which there can be a —COOH substitution as desired), (5) $C_1$-$C_6$ alkyl group in which there can be substitution with OH, halogen, —COOH, —(CO)COOH, aryl, or $OC_1$-$C_6$ alkyl group.)

Among these compounds represented by the above general formulas (f)-(h), particular examples include N-(3-hydroxybutylidene)-p-sulfanilic acid, N-butylidenesulfanilic acid, N-cinnamoylidene sulfanilic acid, 2,4-diamino-6-(2'-methylimidazolyl(1')) ethyl-1,3,5-triazine, 2,4-diamino-6-(2'-ethyl-4-methylimidazolyl (1')) ethyl-1,3,5-triazine, 2,4-diamino-6-(2'-undecylimidazolyl (1')) ethyl-1,3,5-triazine, phenyl salicylate, and the like.

Similarly, for the benzothiazole semi-brightening agent represented by the general formula (1), particular examples include benzothiazole, 2-methylbenzothiazole, 2-(methylmercapto) benzothiazole, 2-aminobenzothiazole, 2-amino-6-methoxybenzothiazole, 2-methyl-5-chlorobenzothiazole, 2-hydroxybenzothiazole, 2-amino-6-methylbenzothiazole, 2-chlorobenzothiazole, 2,5-dimethylbenzothiazole, 6-nitro-2-mercaptobenzothiazole, 5-hydroxy-2-methylbenzothiazole, 2-benzothiazolethioacetic acid, and the like.

By adding phenanthroline compounds or bipyridyl and the like as smoothing agents into the bath, the smoothness and the like of the plate coating is improved over abroad range of current densities from low current density to high current density.

With the above brightening agents, semi-brightening agents, or smoothing agents, by using them together with the aforementioned various surface active agents, the desired effect is further improved by their synergistic effect.

The addition amount of these various additives to the plating bath is 0.001-40 g/L, and preferably 0.01-20 g/L.

The aforementioned auxiliary complexing agent is added together with the aliphatic sulfide compound of the present invention and improves the stability of the bath. On the other hand, the aforementioned suppressing complexing agent is added in order to suppress the simultaneous deposition of impurity metal ions, which dissolve from the plating substrate, with the deposition of the target metal and in order to suppress the deterioration of the bath.

Concrete examples include ethylenediamine tetraacetic acid, iminodiacetic acid, nitrilotriacetic acid, diethyltriamine pentaacetic acid, citric acid, tartaric acid, succinic acid, malonic acid, glycolic acid, glucoheptonic acid, gluconic acid, glycine, pyrophosphoric acid, tripolyphosphoric acid, 1-hydroxyethane-1,1-bis phosphonic acid, and the like.

Furthermore, as the aforementioned conductive salt, compounds normally used in plating baths can be used. For example, sodium salts, potassium salts, magnesium salts, ammonium salts, organic amine salts of sulfuric acid, hydrochloric acid, phosphoric acid, sulfamic acid, sulfonic acid, and the like can be used.

With regard to the aforementioned pH modifying agents, compounds normally used in plating baths can be used. For example, sodium salts, potassium salts, ammonium salts, organic amine salts, and the like of phosphoric acid, acetic acid, boric acid, tartaric acid, and the like can be used. In addition, with polyprotic acids, acidic salts containing hydrogen ions can be used singly or mixed appropriately.

Furthermore, with silver alloy plating baths containing tin salt, such as silver-tin alloy baths, oxidation of tin (I) salt can be effectively suppressed by adding oxidation inhibiting agents such as catechol, hydroquinone, phenolsulfonic acid, naphtholsulfonic acid, ascorbic acid, and the like.

If conducting electroplating with the plating bath of the present invention, the bath temperature is generally 70 degrees C. or lower, and preferably around 10-40 degrees C. Furthermore, the cathode current density will have some variation depending on the type of plating bath, however, in general it is around 0.01-150 A/dm$^2$, and preferably around 0.1-50 A/dm$^2$.

As the procedure for preparing the plating bath of the present invention, a one bath method or a two liquid mixing method can be used. In the one bath method, silver salt, or salts of silver and a specified metal which creates an alloy, a specified aliphatic sulfide compound, surface active agents and other additives are all mixed at once into an acid or alkaline solution, which is the base. In the two liquid mixing method, an aqueous solution of a mixture of at least the silver salt and the aliphatic sulfide compound is combined with the rest of the bath components. In other words, it is essential to prepare the bath under the coexistence of the silver salt with the aliphatic sulfide compound in a stable condition.

In the plating bath of the present invention, the addition concentration of each of the above components can be adjusted and selected as appropriate in response to barrel plating, rack plating, high speed continuous plating, rackless plating, and the like.

[Action]

In the present invention, because each of the plating baths of silver and silver alloy contains a specified aliphatic sulfide compound, it can be hypothesized that the configurational property of the soft base (based on the previously described HSAB principle) of the easily polarized sulfur atom at the sulfide or disulfide bond acts synergistically with the configurational property of the non-shared electron pair of the ether oxygen (or hydroxypropylene group or 3-hydroxypropyl group). As a result, this aliphatic sulfide compound exhibits a good configurational function with respect to the silver ion. (Furthermore, with regard to 3,3'-thiodipropanol and the like, which contains the above 3-hydroxypropyl group within the molecule, this differs from beta-thiodiglycol and the like described in the prior art, It can be hypothesized that the sulfur atom of the sulfide bond and the oxygen atom of this hydroxypropyl group, via silver, form a six-member ring configuration.)

In addition, with the aliphatic sulfide compound of the present invention which contains at least one or more ether oxygen atom, the longer the oxyalkylene chain, the solubility of this compound in the bath increases, and in addition, by the enclosing action of the polyether bond, the silver ion is stabilized further. As a result, the plating operation becomes easier, and the productivity is improved. The bath lifespan is extended, and this is economically advantageous.

ADVANTAGES OF THE INVENTION (1) As described above, with the silver and silver alloy plating bath of the present invention, silver ion in the bath is stabilized by the action of specified sulfide compounds, As a result, the stability over extended time of the plating bath is greatly improved. Consequently, the decomposition of the bath is suppressed over at least six months or greater (refer to the later test examples), and it is very practical as an electroplating bath.

The present invention is a silver or silver alloy plating bath comprising an aliphatic sulfide compound having an ether oxygen, 3-hydroxypropyl group, or ahydroxypropylene group within the molecule, In particular, although the thiodiglycolic acid or beta-thiodiglycol disclosed in prior art 1 is also an aliphatic sulfide compound, they are a different type of aliphatic sulfide compound from the present invention because they do not contain an ether oxygen, 3-hydroxypropyl group or hydroxypropylene group. With baths that contain these other types of compounds, decomposition occurs in a short period of time of around 1 day-5 weeks (refer to Comparative example 2A, B-3A, B of the test examples described later).

Furthermore, although thiourea is a sulfur compound like the aliphatic sulfide compound of the present invention, a bath containing thiourea has extreme turbidity and deposition of silver at around 2-4 weeks (refer to Comparative examples 4A, B of the test examples described later).

Therefore, compared to these known compounds, the aliphatic sulfide compound of the present invention exhibits a marked effect in contributing to the stability of the bath over extended time.

(2) With the non-cyanide silver alloy plating bath of the prior art, decomposition progresses and the long term implementation of electroplating itself is not easy. Even if electroplating can be conducted, the silver co-deposition rate in the electrodeposition coating is poor.

However, when electroplating is conducted using the silver alloy plating bath of the present invention, as shown by the test examples described later, silver and the other metal are reliably co-deposited, and a good silver alloy electrodeposition coating is formed.

Furthermore, with baths containing thiodiglycolic acid or thiourea and the like, when the current density conditions change from low density to high density, there is great variability in the co-deposition rate of silver. With the silver alloy plating bath of the present invention, under current densities of low density to high density, there is minimal variability in the co-deposition rate of silver in the electrodeposition coating, and the silver content in the coating is stabilized. Consequently, the maintenance of the current density during plating is easy, and a plating coating with the composition ratio required for its purpose can be formed easily.

(3) As described in the later test examples, with the electrodeposition coating of silver or silver alloy which uses the plating bath of present inventions 1-3, there were no irregularities, such as burning, dendrites, powdering, or silver substitution deposition with respect to the plating substrate of copper or copper alloy, or silver substitution deposition on to the deposited coating. A practical and favorable coating appearance can be provided.

Furthermore, when surface active agents, brightening agents, semi-brightening agents, smoothing agents, auxiliary complexing agents, suppressing complexing agents, and the like of invention 4 are added to the plating bath, the appearance of the electrodeposition coating is further improved.

(4) With the silver or silver alloy plating bath of the present inventions 1-4, because it is anon-cyanide plating bath in which silver salt is dissolved stably in the bath by the aliphatic sulfide compound, it is safe, and the restrictions on the waste water are reduced, and the waste water treatment costs can be reduced.

Furthermore, the plating bath of the present invention does not use a cyanide compound which is only stable at alkaline pH's, and there are no pH restrictions (including strongly acid). As a result, plating is not limited to alkaline baths, with which there are often restrictions on the types of plating metals. Acid baths and neutral baths can be used favorably. As a result, the variety of metals (silver alloys) which can be plated is broadened, and the pH maintenance of the plating bath becomes easier.

If the aliphatic sulfide compound of the present invention has one or more ether oxygen atoms in the molecule, the longer the oxyalkene chain, the greater the water solubility. As a result, preparation of the bath is easier. Of course, it goes without saying that with the preparation of the plating bath, the compound of the present invention can be dispersed with surface active agents and the like.

Embodiments

Below, embodiments of the silver and silver alloy electroplating baths will be described in order. The tests for the stability over time of the plating baths after they have been prepared, the co-deposition rate of the silver in the electrodeposition coating of silver alloy, or appearance observations for each electrodeposition coating, and the like will be listed together. Furthermore, the present invention is not limited to the following embodiments, and the many changes can be made within the scope of the technical spirit of the present invention.

The following Embodiments 1-5, 17-20, and 25-27 are silver-tin alloy plating baths. Embodiments 6-14, 21-24, and 29-32 are silver alloy plating baths other than silver-tin alloy, starting with silver-bismuth alloy, silver-nickel alloy. Embodiments 15-16 and 28 are silver plating baths.

In addition, Embodiments 26-27, and 29-31 are examples of combined use of aliphatic sulfide compounds, and all of the others are single use examples.

Embodiment 1

A silver-tin alloy plating bath was constructed with the following composition.

Silver methane sulfonate (as $Ag^{+}$) 1 g/L
Tin (I) methane sulfonate (as $Sn^{2+}$) 40 g/L
Methane sulfonic acid 120 g/L
Dithiobis(hentetracontaethyleneglycol) 110 g/L

Embodiment 2

A silver-tin alloy plating bath was constructed with the following composition.

Silver methane sulfonate (as $Ag^{+}$) 0.7 g/L
Tin (I) sulfate (as $Sn^{2+}$) 20 g/L
Sulfuric acid 150 g/L
Octylphenol polyethoxylate (EO15) 5 g/L
Cetyldimethylbenzylammonium methane sulfonate 1 g/L
Beta-naphthol-6-sulfonic acid 0.2 g/L
Thiodiglycerin 70 g/L

Embodiment 3

A silver-tin alloy plating bath was constructed with the following composition.

Silver 2-propanol sulfonate (as $Ag^{+}$) 3 g/L
Tin (I) 2-propanol sulfonate (as $Sn^{2+}$) 60 g/L
2-propanol sulfonic acid 70 g/L
Betaine type amphoteric surface active agent 1 g/L
Cetyldimethylbenzylammonium methane sulfonate 1 g/L
Hydroquinone 1 g/L
Dithiobis (decaglycerol) 50 g/L

Embodiment 4

A silver-tin alloy plating bath was constructed with the following composition.

Silver ethane sulfonate (as $Ag^{+}$) 5 g/L
Tin (I) ethane sulfonate (as $Sn^{2+}$) 30 g/L
Methane sulfonic acid 100 g/L
Gluconic acid 0.7 mol/L
Polyethylenemine 5 g/L
Catechol 0.5 g/L
Thiobis(dodecaethyleneglycol) 60 g/L
pH 4.0 (modified by NaOH)

Embodiment 5

A silver-tin alloy plating bath was constructed with the following composition.

Silver fluoborate (as $Ag^{+}$) 10 g/L
Tin (I) fluoborate (as $Sn^{21}$) 20 g/L
Fluoboric acid 130 g/L
Boric acid 30 g/L
Imidazoline type amphoteric surface active agent 10 g/L
Lauryldimethylbenzylanunonium methane sulfonate 1 g/L
2-mercaptoethylether bis(diethyleneglycol) 100 g/L

Embodiment 6

A silver-bismuth alloy plating bath was constructed with the following composition.

Silver methane sulfonate (as $Ag^{+}$) 20 g/L
Bismuth methane sulfonate (as $Bi^{3+}$) 10 g/L
Methane sulfonic acid 150 g/L
Pluronic type surface active agent 10 g/L
o-chlorobenzaldehyde 0.1 g/L
3,6-dithiaoctane-1,8-diol 80 g/L Embodiment 7

A silver-indium alloy plating bath was constructed with the following composition.
Silver methane sulfonate (as $Ag^+$) 20 g/L
Indium sulfate (as $In^{3+}$) 20 g/L
Methane sulfonic acid 120 g/L
Polyvinyl alcohol 7 g/L
Tetrabutylammonium methane sulfonate 2 g/L
Thiobis(triglycerin) 70 g/L Embodiment 8

A silver-lead alloy plating bath was constructed with the following composition.
Silver methane sulfonate (as $Ag^+$) 20 g/L
Lead methane sulfonate (as $Pb^{2+}$) 20 g/L
Methane sulfonic acid 70 g/L
Beta-naphthol polyethoxylate (EO13) 3 g/L
Polypeptone 1 g/L
2-mercaptoethylsulfide bis(hexatriacontaethyleneglycol) 90 g/L Embodiment 9

A silver-copper alloy plating bath was constructed with the following composition.
Silver methane sulfonate (as $Ag^+$) 20 g/L
Copper (II) sulfate (as $Cu^{2+}$) 20 g/L
Sulfuric acid 100 g/L
Bisphenol A polyethoxylate (EO12) 5 g/L
2,2'-bipyridyl 0.03 g/L
Resorcin 0.3 g/L
1,3-dithioglycerol bis(di(1-methyl)ethyleneglycol) thioether 100 g/L Embodiment 10

A silver-zinc alloy plating bath was constructed with the following composition.
Silver nitrate (as $Ag^+$) 20 g/L
Zinc sulfate (as $Zn^{2+}$) 20 g/L
Sulfuric acid 100 g/L
Amidobetaine type amphoteric surface active agent 2 g/L
Beta-naphthol 1 g/L
Thiobis(icosaethyleneglycol) 80 g/L Embodiment 11

A silver-nickel alloy plating bath was constructed with the following composition.
Silver nitrate (as $Ag^+$) 20 g/L
Nickel sulfate (as $Ni^{2+}$) 5 g/L
Sulfuric acid 100 g/L
Benzyltributylammonium hydroxide 1.5 g/L
2,6-dihydroxynapthalene 1 g/L
Hexadecaethyleneglycol dimethylthioether 120 g/L Embodiment 12

A silver-palladium alloy plating bath was constructed with the following composition.
Silver methane sulfonate (as $Ag^+$) 10 g/L
Palladium methane sulfonate (as $Pd^{2+}$) 1 g/L
Methane sulfonic acid 100 g/L
Polyvinyl pyrrolidone 5 g/L
Disodium ethylenediamine tetraacetate 1 g/L
Decaglycerol mono (6-methylthiohexyl)thioether 150 g/L Embodiment 13

A silver-platinum alloy plating bath was constructed with the following composition.
Silver ethane sulfonate (as $Ag^+$) 10 g/L
Platinum ethane sulfonate (as $Pt^{4+}$) 1 g/L
Ethane sulfonic acid 100 g/L
Cumylphenol polyethoxylate (EO10) 3 g/L
Beta-naphthalene sulfonic acid 1 g/L
Dithiobis(triglycerol) 180 g/L Embodiment 14

A silver-gold alloy plating bath was constructed with the following composition.
Silver 2-propanol sulfonate (as $Ag^+$) 10 g/L
Gold 2-propanol sulfonate (as $Au^+$) 1 g/L
2-propanol sulfonic acid 100 g/L
Alkylglycine amphoteric surface active agent 1.5 g/L
Imidazole 0.5 g/L
2,2'-thiodibutanol bis(octaethyleneglycol pentaglycerol) ether 100 g/L Embodiment 15

A silver plating bath was constructed with the following composition.
Silver citrate (as $Ag^+$) 20 g/L
Citric acid 100 g/L
N-(3-hydroxybutylidene)-p-sulfanilic acid 3 g/L
Poly(oxyethylene-oxypropylene)glycol monoalkylether 5 g/L
1,3-dithioglycerol bis(pentaethyleneglycol) thioether 130 gL
pH=4.0 (modified with ammonia)

Embodiment 16

A silver plating bath was constructed with the following composition.
Silver tartrate (as $Ag^+$) 20 g/L
Tartaric acid 100 g/L
Alkyl(coconut) amine polyethoxylate (EO15) 1 g/L
Imidazoline type amphoteric surface active agent 5 g/L
Thiobis(pentacontaethyleneglycol) 120 g/L
pH=4.0 (modified with ammonia)

Embodiment 17

A silver-tin alloy plating bath was constructed with the following composition.
Silver methane sulfonate (as $Ag^+$) 1 g/L
Tin (I) methane sulfonate (as $Sn^{2+}$) 45 g/L
Methane sulfonic acid 110 g/L
Bisphenol A polyethoxylate (EO13) 20 g/L
Dibutylnaphthalene sulfonic acid 1 g/L
3,3'-thiodipropanol 50 g/L Embodiment 18

A silver-tin alloy plating bath was constructed with the following composition.
Silver methane sulfonate (as $Ag^+$) 1 g/L
Tin (I) methane sulfonate (as $Sn^{2+}$) 45 g/L
Methane sulfonic acid 120 g/L
Nonylphenol polyethoxylate (EO15) 8 g/L
Thiobis(dodecaethyleneglycol) 20 g/L Embodiment 19

A silver-tin alloy plating bath was constructed with the following composition.
Silver methane sulfonate (as $Ag^+$) 0.7 g/L
Tin (I) sulfate (as $Sn^{2+}$) 20 g/L
Sulfuric acid 150 g/L
Cetyldimethylbenzylammonium methane sulfonate 1 g/L
Beta-naphthol-6-sulfonic acid 1 g/L
Triacontaethyleneglycol mono(2-methylthioethyl)thioether 100 g/L Embodiment 20

A silver-tin alloy plating bath was constructed with the following composition.
Silver 2-propanol sulfonate (as $Ag^+$) 3 g/L
Tin (I) 2-propanol sulfonate (as $Sn^{2+}$) 60 g/L
2-propanol sulfonic acid 100 g/L
Betaine type amphoteric surface active agent 1 g/L
Cetyldimethylbenzylammonium methane sulfonate 1 g/L
Catechol 0.5 g/L
1,2-ethanedithiol bis(icosaethyleneglycol)thioether 250 g/L Embodiment 21

A silver-copper alloy plating bath was constructed with the following composition.
Silver methane sulfonate (as $Ag^+$) 20 g/L
Copper sulfate (as $Cu^{2+}$) 20 g/L
Sulfuric acid 100 g/L
Styrenated phenol polyethoxylate (E023) 5 g/L
2,2'-bipyridyl 0.03 g/L
Hydroquinone 0.7 g/L
Thiobis(decaethyleneglycol) bis(carboxymethyl)ether 150 g/L Embodiment 22

A silver-lead alloy plating bath was constructed with the following composition.
Silver methane sulfonate (as $Ag^+$) 20 g/L
Lead methane sulfonate (as $Pb^{2+}$) 20 g/L
Methane sulfonic acid 80 g/L
Alpha-naphthol polyethoxylate (EO13) 3 g/L
Oleylamine polyethoxylate (EO18) 2 g/L
1,4-butanedithiol bis(pentadecaglycerol)thioether 180 g/L Embodiment 23

A silver-bismuth alloy plating bath was constructed with the following composition.
Silver methane sulfonate (as $Ag^+$) 20 g/L
Bismuth methane sulfonate (as $Bi^{3+}$) 10 g/L
Methane sulfonic acid 150 g/L
Cumylphenol polyethoxylate (EO15) 3 g/L
Pluronic type surface active agent 7 g/L
Thiobis(pentadecaglycerol) 80 g/L Embodiment 24

A silver-zinc alloy plating bath was constructed with the following composition.
Silver nitrate (as $Ag^+$) 20 g/L
Zinc sulfate (as $Zn^{2+}$) 20 g/L
Sulfuric acid 100 g/L
Amidobetaine type amphoteric surface active agent 2 g/L
Polyethylene imine 3 g/L
Hexadecaethyleneglycol mono(2-methylthioethyl)thioether 180 g/L Embodiment 25

A silver-tin alloy plating bath was constructed with the following composition.
Silver 2-propanol sulfonate (as $Ag^+$) 3 g/L
Tin (I) 2-propanol sulfonate (as $Sn^{2+}$) 60 g/L
Methane sulfonic acid 80 g/L
Styrenated phenol polyethoxylate (EO20) 5 g/L
Dibutylnaphthalene sulfonic acid 1 g/L
Hydroquinone 0.3 g/L
Dithiobis(pentadecaethyleneglycol) 60 g/L Embodiment 26

A silver-tin alloy plating bath was constructed with the following composition.
Silver methane sulfonate (as $Ag^+$) 0.7 g/L
Tin (I) sulfate (as $Sn^{21}$) 20 g/L
Sulfuric acid 150 g/L
Octylphenol polyethoxylate (EO12) 3 g/L
Laurylalcohol polyethoxylate (EO15) 2 g/L
Hydroquinone 0.7 g/L
Triacontaethyleneglycol mono(2-methylthioethyl)thioether 50 g/L
Thiobis(dodecaethyleneglycol) 2 g/L Embodiment 27

A silver-tin alloy plating bath was constructed with the following composition.
Silver methane sulfonate (as $Ag^+$) 1 g/L
Tin (I) methane sulfonate (as $Sn^{2+}$) 40 g/L
Methane sulfonic acid 120 g/L
Laurylalcohol polyethoxylate (EO15) polypropoxylate (PO3) 7 g/L
Beta-naphthol 1 g/L
Thiobis(icosaethyleneglycol) 15 g/L
Dithiobis (hentetracontaethyleneglycol) 20 g/L Embodiment 28

A silver plating bath was constructed with the following composition.
Silver tartrate (as $Ag^+$) 20 g/L
Tartaric acid 100 g/L
Alkyl(coconut) amine polyethoxylate (EO15) 1 g/L
Imidazoline type amphoteric surface active agent 5 g/L
Dithiobis(triglycerol) 150 g/L
pH=4.0 (modified with ammonia)

Embodiment 29

A silver-nickel alloy plating bath was constructed with the following composition.
Silver nitrate (as $Ag^+$) 20 g/L
Nickel nitrate (as $Ni^{2+}$) 5 g/L
Sulfuric acid 100 g/L
Benzyltributylammonium hydroxide 1.5 g/L
2,6-dihydroxynaphthalene 1 g/L
Undecaethyleneglycol di(n-propyl) thioether 50 g/L
Hexadecaethyleneglycol mono(2-methylthioethyl) thioether 50 g/L Embodiment 30

A silver-palladium alloy plating bath was constructed with the following composition.
Silver methane sulfonate (as $Ag^+$) 10 g/L
Palladium methane sulfonate (as $Pd^{2+}$) 1 g/L
Methane sulfonic acid 100 g/L
Polyvinyl pyrrolidone 5 g/L
Disodium EDTA 1 g/L
Thiobis(dodecaethyleneglycol) 10 g/L
Thiobis(pentadecaglycerol) 20 g/L Embodiment 31

A silver-platinum alloy plating bath was constructed with the following composition.
Silver ethane sulfonate (as $Ag^+$) 10 g/L
Platinum ethane sulfonate (as $Pt^{2+}$) 1 g/L
Ethane sulfonic acid 100 g/L
Cumylphenol polyethoxylate (EO10) 4 g/L
Beta-naphthalene sulfonic acid 0.8 g/L
Thiobis(triglycerin) 50 g/L
Dithiobis (hentetracontaethyleneglycol) 100 g/L Embodiment 32

A silver-gold alloy plating bath was constructed with the following composition.
Silver 2-propanol sulfonate (as $Ag^+$) 10 g/L
Gold 2-propanol sulfonate (as $Au^+$) 1 g/L
Methane sulfonic acid 100 g/L
Alkylglycine type amphoteric surface active agent 1.5 g/L
Beta-naphthol polyethoxylate (EO12) 2 g/L
Triacontaethyleneglycol mono(2-methylthioethyl) thioether 100 g/L Comparative Example 1A A silver-tin alloy plating bath was constructed as Comparative example 1. Comparative example 1 uses the plating bath of Embodiment 18 as the base composition and is a blank example in which the aliphatic sulfide compound is omitted. (In other words, the content for all of the components except for the omitted component is the same as in the base composition. This is the same for Comparative example 1B.)

Comparative Example 1B

A silver plating bath was constructed as Comparative example 1B. Comparative example 1B uses the plating bath of Embodiment 15 as the base composition and is a blank example in which the aliphatic sulfide compound is omitted.

Comparative Example 2A

Thiodiglycolic acid and beta-thiodiglycol, which are disclosed in prior art 1 described in the beginning, are aliphatic sulfide compounds as are the compounds of the present invention. A silver-tin alloy plating bath was constructed as Comparative example 2A using the plating bath of Embodiment 18 as the base composition and substituting thiobis(dodecaethyleneglycol) with the thiodiglycolic acid. (In other words, the content for the substituted component and all the other components are the same as the base embodiment. This is the same for Comparative examples 2B, 3A-B, 4A-B).

Comparative Example 2B

A silver plating bath was constructed as Comparative example 2B, using the plating bath of Embodiment 15 as the base composition and substituting 1,3-dithioglycerol bis (pentaethyleneglycol) thioether with the above thiodiglycolic acid.

Comparative Example 3A

A silver-tin alloy plating bath was constructed as Comparative example 3A, using the plating bath of Embodiment 18 as the base composition and substituting thiobis(dodecaethyleneglycol) with the above beta-thiodiglycol.

Comparative Example 3B

A silver plating bath was constructed as Comparative example 3B, using the plating bath of Embodiment 15 as the base composition and substituting 1,3-dithioglycerol bis (pentaethyleneglycol) thioether with the above beta-thiodiglycol.

Comparative Example 4A

As described in the beginning, thiourea is known as a chelating agent for silver. A silver-tin alloy plating bath was constructed as Comparative example 4A, using the plating bath of Embodiment 18 as the base composition and substituting thiobis(dodecaethyleneglycol) with the thiourea.

Comparative Example 4B

A silver plating bath was constructed as Comparative example 4B, using the plating bath of Embodiment 15 as the base composition and substituting 1,3-dithioglycerol bis (pentaethyleneglycol) thioether with the above thiourea.

In silver and silver alloy plating baths, because it is so easy for the bath to decompose and for the silver to precipitate, the stability of the bath is extremely important. In the following tests, first, the changes over time of the baths were observed, and their ability to maintain a practicable stability was investigated. In addition, the co-deposition rate of silver in the electrodeposition coatings obtained from the plating baths was measured, and tests were conducted to confirm the presence of any irregularities on these electrodeposition coatings (in other words, whether or not the coating appearance is at a useable level), However, because it can be hypothesized that the stability of the bath depends on the action of the specified aliphatic sulfide compound with respect to the silver ions in the bath, in the following tests, silver-tin alloy plating baths were used to represent silver alloy plating baths.

<<Test of Changes Over Time of the Plating Bath>>

The time starting from the construction of each of the above plating baths until bath decomposition by deposition of silver or clouding and the like was studied under room temperature.

(1) Test Results

Referring to Tables 1-5, the results are shown.

Whereas there was no decomposition of the silver and silver alloy plating baths of any of the Embodiments 1-32 up to 180 days, there was decomposition immediately after preparation with the silver-tin alloy plating bath of the blank example of Comparative example 1A, and there was silver deposition on the walls of the container housing the bath at around one week with the silver plating bath of the blank example of Comparative example 1B. Decomposition occurred at 1-10 days for Comparative examples 2A-3A (silver-tin alloy baths) containing thiodiglycolic acid or beta-thiodiglycol. Decomposition occurred at two weeks or five weeks for Comparative examples 2B-3B (silver baths). Furthermore, there was extreme clouding after two weeks for Comparative example 4A (silver-tin alloy bath) which contained thiourea. For Comparative example 4B (silver bath), silver was deposited on the container walls at 4 weeks.

(2) Evaluation of Test Results

Being able to continue to use an electroplating bath for over several months is a minimum requirement.

According to the above test results, the silver plating baths and various silver alloy plating baths containing the aliphatic sulfide compounds of the present invention (Embodiments 1-32) did not decompose and was stable for at least 6 months. As a result, it is clear that the present invention satisfies the minimum practicable level as an electroplating bath. With the aliphatic sulfide compound of the present invention, the basic principle is that the silver ions are stabilized in the bath by the complexing action of the sulfide or disulfide bond. In particular, with compounds having an oxyalkylene chain, there is an enclosing action by the polyether bond, and with compounds having a 3-hydroxypropyl group, the oxygen atom of the 3-hydroxypropyl group and the sulfur atom of the sulfide bond form a six-member configurational construction with respect to the silver ion. As a result, it can be hypothesized that the capability of complexing to each of the silver ions is further strengthened.

In contrast, the blank examples (Comparative examples 1A and 1B), which did not contain the compounds of the present invention, decomposed immediately after to 1 week after and were not at all practical. With the plating bath containing thiodiglycolic acid (Comparative examples 2A-2B), decomposition occurred at 1 day and at 2 weeks, and with the baths containing beta-thiodiglycol (Comparative examples 3A-3B), decomposition occurred at 10 days and at 5 weeks.

In addition, with baths containing thiourea (Comparative examples 4A-4B), decomposition occurred at around 2 and 4 weeks.

In the above Comparative examples 2A-4A, Embodiment 18 was the base composition. These baths are silver-tin alloy plating baths containing the same content (20 g/L) of an aliphatic sulfide compound. Comparing these, first, the stability of the bath containing beta-thiodiglycol (Comparative example 3A) increased slightly compared to the bath containing thiodiglycolic acid (Comparative example 2A) (from 1 day to 10 days), However, the bath containing the aliphatic sulfide compound of the present invention of thiobis(dodecaethyleneglycol) (Embodiment 18) was stable over a long period of time of over 6 months. Compared to the bath containing beta-thiodiglycol which decomposed after only 10 days, the differences between them are obvious. In addition, the bath containing thiourea (Comparative example 4A) decomposed at around 2 weeks.

Similar results were shown by the silver plating baths of the B series. The reason the decomposition of the B series is slower than in the A series is thought to be because the content of the compounds, such as thiodiglycolic acid or beta-thiodiglycol and the like is higher than in the A series.

Therefore, it was confirmed that the plating baths containing the aliphatic sulfide compounds of the present invention have a markedly superior stability of the bath overextended time compared to various Comparative examples IA, B-4A, B.

<<Measurement Test of the Silver Co-Deposition Rate>>

With the various silver alloy plating baths including silver-tin alloy, silver-bismuth alloy plating baths (Embodiments 1-14, 17-27, and 29-32, and Comparative examples 2A and 3A), the current density conditions were changed and electroplating was conducted (refer to Tables 1-5). The co-deposition rate of silver in the electrodeposition coating was measured using an ICP device (a fluorescent X-ray film thickness measure is also possible).

Because Comparative example 1A decomposed immediately after preparation, electroplating could not be implemented.

In addition, Comparative example 2A had an extremely poor bath stability, decomposing after one day, and achieving the co-deposition of silver and tin was difficult. As a result, electroplating was not implemented.

(1) Test Results and their Evaluation.

Referring to Tables 1-5, the results are shown.

With the silver alloy plating baths of Embodiments 1-14, 17-27, and 29-32, there was little variation in the co-deposition rate of silver even when the cathode current density condition changed from low density to high density, It was confirmed that there was consistent co-deposition of silver and another metal within a stable ratio range.

For example, with silver-tin alloy plating baths, comparing Embodiment 3, containing an aliphatic disulfide compound of the present invention, and Embodiment 18, containing an aliphatic monosulfide compound, with Comparative examples 3A-4A, it can be confirmed that there is little variation in Embodiments 3, 18. For example, when the current density changed from 5 to 20 A/dm$^2$, the silver co-deposition rate was within a narrow range of variation of 9.2-3.6% for Embodiment 3 and 7.6-2.9% for Embodiment 18. In contrast, there was large variability with Comparative Example 4A of 57.4-3.1%. With Comparative example 3A, the variability was limited to 9.6-2.8%.

With silver-tin alloy plating coating, coatings with a low silver content are effective in preventing tin whiskers. By using the plating bath of the present invention, the co-deposition rate of silver is relatively stable even when the current density is changed variously. As a result, the maintenance of current density is easy, and various compositions for silver alloy coatings can be readily formed according to the various purpose.

Furthermore, with regard to the relationship between the Embodiments and the Comparative examples, by looking at the silver co-deposition rate under the same current density conditions (for example, 5 A/dm$^2$), Embodiment 3 was 9.2% and Embodiment 18 was 7.6%, and in contrast, Comparative example 4A was 57.4%. The aliphatic sulfide compound containing the ether oxygen atom of the present invention has a stronger stabilizing action with respect to the silver ions in the bath compared to thiourea. Even when the same current density is applied, the silver ions are not as readily reduced to silver metal. It can be hypothesized that this is why the co-deposition rates for Embodiments 3 and 18 are relatively small. With thiodiglycolic acid, which is similarly an aliphatic sulfide compound, the stability of the bath was very poor as described previously, and the co-deposition of silver and tin was difficult. On the other hand, beta-thiodiglycol achieved a practicable level in terms of co-deposition rate (although it was similarly inferior in terms of bath stability).

In other words, the differences in the stabilizing action with respect to the silver alloy plating bath were manifested in differences in the co-deposition rate of silver under the same current densities. It can be hypothesized that the smaller the co-deposition rate, the more stable the plating bath.

<<Appearance Test of the Plate Coating>>

With the various silver and silver alloy plating baths (Embodiments 1-32, Comparative examples 1B, 2A, B-4A, B), current density conditions were changed and electro plating was conducted. The appearance of the electrodeposited coatings obtained from the baths was studied by eye. Presence of any irregularities of burning, dendrites, or powdering, and the like was confirmed. They were examined to see whether or not they achieved the necessary minimum level as a practicable plating coating. For the same reasons as in the above test, the test for Comparative example 1A could not be implemented. In addition, with Comparative example 2A, the stability of the plating bath was extremely poor, and it was difficult to obtain an electrodeposition coating of silver-tin alloy. As a result, this test was not conducted.

(1) Test Results and their Evaluation.

Referring to Tables 1-5, the results are shown.

Evaluation standards for these test results are as follows. Circle: no irregularities in the coating appearance. A useable level was maintained. Triangle: powdering and the like were observed. The outer appearance was below a useable level. X: extreme burning, dendrites and the like were observed. The coating appearance was very inferior.

Describing the test results in detail, the silver and silver alloy coatings of Embodiments 1-32 had no irregularities such as burning or dendrites even when the current densities were changed. A usable level for the plating coating was maintained, and they all were evaluated as circles. In contrast, the silver-tin alloy plating coating of Comparative example 3A containing beta-thiodiglycol, had some problems in the appearance at current densities of 5 A/dm$^2$ and 20 A/dm$^2$ and were evaluated as triangles. The silver-tin alloy plating coating of Comparative example 4A, containing thiourea, all had irregularities of powdering or burning and the like and were evaluated as triangles or X's.

For the silver plating coating of Comparative example 1B, which is a blank example, there was much black powdering, and all of the evaluations were X's. The silver plating coatings of Comparative examples 2B, 3B all had irregularities of powdering or burning and were triangles or X's. The silver plating coating of Comparative example 4B containing thiourea was the same as Comparative examples 2B, 3B.

As described above, the plating coating of the comparative examples, except for Comparative example 3A, were all greatly inferior to a useable level of appearance, and Comparative example 3A also still had problems. As a result, in terms of appearance of electrodeposition coatings, there clearly is a dramatic difference between the aliphatic sulfide compounds of the present invention and the thiodiglycolic acid or thiourea and the like.

Table 1 is a table showing the type of silver alloy plating bath, stability test results of the bath, silver co-deposition rate, and appearance observation results of the electrodeposition coating for Embodiments 1-8.

Table 2 is a table analogous to Table 1 showing the silver alloy plating baths and silver plating baths of Embodiments 9-16.

Table 3 is a table analogous to Table 1 showing the silver alloy plating baths of Embodiments 17-24.

Table 4 is a table analogous to Table 1 showing the silver alloy plating baths and silver plating baths of Embodiments 25-32.

Table 5 is a table analogous to Table 1 showing the silver alloy plating baths and silver plating baths of Comparative examples IA, B-4A, B.

TABLE 1

Bath temperature: 25 degrees C., Current density: A/dm$^2$

| | | | Co-deposition rate of silver | | Electro-deposition |
|---|---|---|---|---|---|
| | Type of bath | Stability of bath | Current density | Co-deposition rate (%) | coating appearance presence of burning, dendrites, and the like |
| Embodiment 1 | Ag—Sn | No | 5 | 9 | ○ |
| | | decomposition | 10 | 4 | ○ |
| | | up to 180 days | 20 | 3 | ○ |
| Embodiment 2 | Ag—Sn | No | 2 | 11 | ○ |
| | | decomposition | 5 | 6 | ○ |
| | | up to 180 days | 10 | 3 | ○ |
| Embodiment 3 | Ag—Sn | No | 5 | 9.2 | ○ |
| | | decomposition | 10 | 5.1 | ○ |
| | | up to 180 days | 20 | 3.6 | ○ |
| Embodiment 4 | Ag—Sn | No | 5 | 35.1 | ○ |
| | | decomposition | 10 | 24.7 | ○ |
| | | up to 180 days | 20 | 13.8 | ○ |
| Embodiment 5 | Ag—Sn | No | 5 | 58.1 | ○ |
| | | decomposition | 10 | 44.6 | ○ |
| | | up to 180 days | 20 | 33.7 | ○ |
| Embodiment 6 | Ag—Bi | No | 5 | 93.1 | ○ |
| | | decomposition | 10 | 88.3 | ○ |
| | | up to 180 days | 20 | 76.8 | ○ |
| Embodiment 7 | Ag—In | No | 2 | 64.1 | ○ |
| | | decomposition | 5 | 52.4 | ○ |
| | | up to 180 days | 10 | 51.1 | ○ |
| Embodiment 8 | Ag—Pb | No | 5 | 73.4 | ○ |
| | | decomposition | 10 | 66.3 | ○ |
| | | up to 180 days | 20 | 57.1 | ○ |

TABLE 2

| Bath temperature: 25 degrees C., Current density: A/dm$^2$ | | | | | |
|---|---|---|---|---|---|
| | | | Co-deposition rate of silver | | Electro-deposition |
| | Type of bath | Stability of bath | Current density | Co-deposition rate (%) | coating appearance presence of burning, dendrites, and the like |
| Embodiment 9 | Ag—Cu | No | 5 | 60.9 | ○ |
| | | decomposition | 10 | 58.6 | ○ |
| | | up to 180 days | 20 | 54.2 | ○ |
| Embodiment 10 | Ag—Zn | No | 5 | 78.2 | ○ |
| | | decomposition | 10 | 71.9 | ○ |
| | | up to 180 days | 20 | 70.1 | ○ |
| Embodiment 11 | Ag—Ni | No | 2 | 54.2 | ○ |
| | | decomposition | 5 | 65.9 | ○ |
| | | up to 180 days | 10 | 81.7 | ○ |
| Embodiment 12 | Ag—Pd | No | 1 | 75.9 | ○ |
| | | decomposition | 2 | 81.5 | ○ |
| | | up to 180 days | 5 | 90.8 | ○ |
| Embodiment 13 | Ag—Pt | No | 1 | 83.7 | ○ |
| | | decomposition | 2 | 86.5 | ○ |
| | | up to 180 days | 5 | 89.4 | ○ |
| Embodiment 14 | Ag—Au | No | 1 | 80.6 | ○ |
| | | decomposition | 2 | 86.4 | ○ |
| | | up to 180 days | 5 | 91.9 | ○ |
| Embodiment 15 | Ag | No | 1 | — | ○ |
| | | decomposition | 2 | — | ○ |
| | | up to 180 days | 5 | — | ○ |
| Embodiment 16 | Ag | No | 1 | — | ○ |
| | | decomposition | 2 | — | ○ |
| | | up to 180 days | 5 | — | ○ |

TABLE 3

| Bath temperature: 25 degrees C., Current density: A/dm$^2$ | | | | | |
|---|---|---|---|---|---|
| | | | Co-deposition rate of silver | | Electro-deposition |
| | Type of bath | Stability of bath | Current density | Co-deposition rate (%) | coating appearance presence of burning, dendrites, and the like |
| Embodiment 17 | Ag—Sn | No | 5 | 7.4 | ○ |
| | | decomposition | 10 | 3.7 | ○ |
| | | up to 180 days | 20 | 3.0 | ○ |
| Embodiment 18 | Ag—Sn | No | 5 | 7.6 | ○ |
| | | decomposition | 10 | 4.0 | ○ |
| | | up to 180 days | 20 | 2.9 | ○ |
| Embodiment 19 | Ag—Sn | No | 2 | 10.1 | ○ |
| | | decomposition | 5 | 6.8 | ○ |
| | | up to 180 days | 10 | 3.2 | ○ |
| Embodiment 20 | Ag—Sn | No | 5 | 9.3 | ○ |
| | | decomposition | 10 | 4.2 | ○ |
| | | up to 180 days | 20 | 3.3 | ○ |
| Embodiment 21 | Ag—Cu | No | 5 | 62.2 | ○ |
| | | decomposition | 10 | 59.1 | ○ |
| | | up to 180 days | 20 | 54.9 | ○ |
| Embodiment 22 | Ag—Pb | No | 5 | 74.9 | ○ |
| | | decomposition | 10 | 68.5 | ○ |
| | | up to 180 days | 20 | 57.1 | ○ |
| Embodiment 23 | Ag—Bi | No | 5 | 94.4 | ○ |
| | | decomposition | 10 | 88.3 | ○ |
| | | up to 180 days | 20 | 80.2 | ○ |
| Embodiment 24 | Ag—Zn | No | 5 | 74.1 | ○ |
| | | decomposition | 10 | 69.6 | ○ |
| | | up to 180 days | 20 | 68.1 | ○ |

TABLE 4

| Bath temperature: 25 degrees C., Current density: A/dm$^2$ | | | | | |
|---|---|---|---|---|---|
| | | | Co-deposition rate of silver | | Electro-deposition |
| | Type of bath | Stability of bath | Current density | Co-deposition rate (%) | coating appearance presence of burning, dendrites, and the like |
| Embodiment 25 | Ag—Sn | No | 5 | 8.7 | ○ |
| | | decomposition | 10 | 4.5 | ○ |
| | | up to 180 days | 20 | 3.4 | ○ |
| Embodiment 26 | Ag—Sn | No | 2 | 10.7 | ○ |
| | | decomposition | 5 | 6.1 | ○ |
| | | up to 180 days | 10 | 3.2 | ○ |
| Embodiment 27 | Ag—Sn | No | 5 | 9.8 | ○ |
| | | decomposition | 10 | 4.7 | ○ |
| | | up to 180 days | 20 | 3.3 | ○ |
| Embodiment 28 | Ag | No | 1 | — | ○ |
| | | decomposition | 2 | — | ○ |
| | | up to 180 days | 5 | — | ○ |
| Embodiment 29 | Ag—Ni | No | 2 | 53.8 | ○ |
| | | decomposition | 5 | 69.2 | ○ |
| | | up to 180 days | 10 | 84.4 | ○ |
| Embodiment 30 | Ag—Pd | No | 1 | 76.9 | ○ |
| | | decomposition | 2 | 80.8 | ○ |
| | | up to 180 days | 5 | 87.2 | ○ |
| Embodiment 31 | Ag—Pt | No | 1 | 81.5 | ○ |
| | | decomposition | 2 | 84.4 | ○ |
| | | up to 180 days | 5 | 89.1 | ○ |
| Embodiment 32 | Ag—Au | No | 1 | 82.7 | ○ |
| | | decomposition | 2 | 86.4 | ○ |
| | | up to 180 days | 5 | 91.8 | ○ |

TABLE 5

| Bath temperature: 25 degrees C., Current density: A/dm$^2$ | | | | | |
|---|---|---|---|---|---|
| | | | Co-deposition rate of silver | | Electro-deposition coating appearance |
| | Type of bath | Stability of bath | Current density | Co-deposition rate (%) | presence of burning, dendrites, and the like |
| Comparative | Ag—Sn | Decomposition | — | — | — |
| Example 1A | Blank | immediately | — | — | — |
| | | after | — | — | — |
| | | preparation | | | |
| Comparative | Ag | Silver | 1 | — | X (black powder) |
| Example 1B | Blank | deposition on | 2 | — | X (black powder) |
| | | container walls | 5 | — | X (black powder) |
| | | in 1 week | | | |
| Comparative | Ag—Sn | Decomposition | 5 | — | — |
| Example 2A | Containing | in 1 day | 10 | — | — |
| | thiodyglycolic | | 20 | — | — |
| | acid | | | | |
| Comparative | Ag | Decomposition | 1 | — | Δ (powder) |
| Example 2B | Containing | in 2 weeks | 2 | — | Δ (powder) |
| | thiodyglycolic | | 5 | | X (burn, dendrite) |
| | acid | | | | |
| Comparative | Ag—Sn | Decomposition | 5 | 9.6 | Δ |
| Example 3A | Containing | in 10 days | 10 | 5.5 | ○ |
| | Beta- | | 20 | 2.8 | Δ |
| | thiodiglycol | | | | |
| Comparative | Ag | Decomposition | 1 | — | Δ (powder) |
| Example 3B | Containing | in 5 weeks | 2 | — | Δ (powder) |
| | Beta- | | 5 | — | X (burn, dendrite) |
| | thiodiglycol | | | | |
| Comparative | Ag—Sn | Extreme | 5 | 57.4 | Δ (powder) |
| Example 4A | Containing | clouding at 2 | 10 | 41.9 | Δ (powder) |
| | thiourea | weeks after | 20 | 3.1 | X (burn, dendrite) |
| | | preparation | | | |

TABLE 5-continued

| Bath temperature: 25 degrees C., Current density: A/dm$^2$ | | | | | |
|---|---|---|---|---|---|
| | | | Co-deposition rate of silver | | Electro-deposition coating appearance |
| | Type of bath | Stability of bath | Current density | Co-deposition rate (%) | presence of burning, dendrites, and the like |
| Comparative Example 4B | Ag Containing thiourea | Silver deposition on container walls in 4 weeks | 1 | — | Δ (powder) |
| | | | 2 | — | Δ (powder) |
| | | | 5 | — | X (burn, dendrite) |

What is claimed is:

1. A silver and silver alloy plating bath, comprising:

(A) a soluble salt, comprising a silver salt or a mixture of a silver salt and a salt of a metal selected from the group consisting of tin, bismuth, cobalt, antimony, iridium, indium, lead, copper, iron, zinc, nickel, palladium, platinum, and gold; and (B) at least one aliphatic sulfide compound comprising a functionality selected from the group consisting of an ether oxygen atom, a 3-hydroxypropyl group, and a hydroxypropylene group, with the proviso that the aliphatic sulfide compound does not comprise a basic nitrogen atom.

2. The silver and silver alloy plating bath of claim 1, wherein:

said aliphatic sulfide compound of (B) is selected from the group consisting of aliphatic monosulfide compounds and aliphatic disulfide compounds.

3. The silver and silver alloy plating bath of claim 1 or claim 2, wherein:

said aliphatic sulfide compound of (B) is a compound represented by a general formula I $$R_e—R_a—[(X—R_b)_L—(Y—R_c)_M—(Z—R_d)_N]—R_f$$

wherein M represents an integer of 1-100;

L and N each represent an integer of 0 or 1-100,

Y represents S or S—S;

X and Z each represent O, S, or S—S, $R_a$ represents a straight chain or branched alkylene of $C_1$-$C_{12}$ or a 2-hydroxypropylene, $R_b$, $R_c$ and $R_d$ represent alkylenes of methylene, ethylene, propylene, 2-hydroxypropylene, butylene, pentylene, or hexylene; and for X—$R_b$, Y—$R_c$, and Z—$R_d$, there are no limitations on their mutual positions, and the sequence can be random, provided that when each of the bonds of X—$R_b$, Y—$R_c$, or Z—$R_d$ is to be repeated, each of the bonds can be constructed from a plurality of types of bonds, $R_e$ and $R_f$ represent (i) hydrogen; or (ii) halogen, cyano, formyl, carboxyl, acyl, nitro, hydroxy; or (iii) alkyl, alkenyl, alkynyl, aralkyl, cycloalkyl, allyl, polycyclic cycloalkyl, acetyl, or aryl; or (iv)-O-alkyl, —S-alkyl, —O-alkenyl, —O-alkynyl, —O-aralkyl, —O-cycloalkyl, —O-allyl, —O-polycyclic cycloalkyl, —O-acetyl, or —O-aryl and in (iii) and (iv), all of the functional groups can be substituted with halogen, cyano, formyl, alkoxy, carboxyl, acyl, nitro, or hydroxy, provided that at least one of X and Z represents an oxygen atom and if at least one of $R_e$, $R_f$ is a functional group of the (iv) excluding —S-alkyl or is a propyl group with a hydroxyl group substitution, or if at least one of $R_b$, $R_c$, and $R_d$ is a 2-hydroxypropylene group, neither X nor Z has to be an oxygen atom; and if L=N=0, at least one of $R_e$, $R_f$ is a functional group of (iv) excluding —S-alkyl or is a propyl group with a hydroxyl group substitution, or $R_c$ is a 2-hydroxypropylene group and if $R_b$, $R_c$, and $R_e$ are 2-hydroxypropylene groups, at the hydroxyl group at their 2-position, an oxyethylene, oxypropylene, or oxy (2-hydroxy) propylene group can be further addition polymerized.

4. The silver and silver alloy plating bath of claim 1, wherein:

said plating bath further contains at least one surface active agent, semi-brightening agent, brightening agent, smoothing agent, conductive salt, pH modifying agent, auxiliary complexing agent, suppressing complexing agent, or oxidation inhibiting agent.

5. The plating bath of claim 2, wherein:

said at least one aliphatic sulfide compound is at least one compound represented by a general formula (II)

$$R_e—R_a—(X—R_b)_L—R_f \quad (II)$$

wherein:

L represents an integer from 1 to 300;

for each L, each X independently represents O, S, or S—S provided that at least one X is selected from the group consisting of S and S—S;

$R_a$ is straight chain or branched $C_1$-$C_{12}$ alkylene or a 2-hydroxypropylene;

for each L, each $R_b$ independently represents an alkylene selected from the group consisting of methylene, ethylene, propylene, 2-hydroxypropylene, butylene, pentylene, and hexylene;

$R_e$ and $R_f$ are each independently selected from the group consisting of a hydrogen atom, a halogen, a cyano group, a formyl group, a carboxyl group, an acyl group, a nitro group, a hydroxy group, an optionally substituted alkyl group, an optionally substituted alkenyl group, an optionally substituted alkynyl group, an optionally substituted aralkyl group, an optionally substituted cycloalkyl group, an optionally substituted allyl group, an optionally substituted polycyclic cycloalkyl group, an optionally substituted acetyl group, an optionally substituted aryl group, an optionally substituted —O-alkyl group, an optionally substituted-S-alkyl group, an optionally substituted-O-alkenyl group, an optionally substituted-O-alkynyl group, an optionally substituted-O-aralkyl group, an optionally substituted-O-cycloalkyl group, an optionally substituted-O-allyl group, an optionally substituted-O-polycyclic cycloalkyl group, an optionally substituted-O-acetyl group, and an optionally substituted —O-aryl group, wherein the substituents are selected from the group consisting of halogen, cyano, formyl, alkoxy, carboxyl, acyl, nitro, and hydroxy;

provided that, if at least one of $R_b$ is not a 2-hydroxypropylene group and at least one of $R_e$ and $R_f$ does not contain an ether oxygen or a hydroxyl, then at least one X is an oxygen atom;

further provided that if L=1, then at least one of $R_e$ and $R_f$ is one of a functional group having an ether oxygen or a propyl group with a hydroxyl group substitution, or $R_b$ is a 2-hydroxypropylene group.

6. The plating bath of claim 5, wherein:

at least one $R_b$ is a 2-hydroxypropylene group; and said at least one $R_b$ is optionally polymerized at its 2-position with a group selected from an oxyethylene group, an oxypropylene group, or an oxy(2-hydroxy)propylene group.

7. The silver and silver alloy plating bath of claim 1, wherein:

the plating bath is a non-cyanide silver or silver alloy plating bath.

8. The silver and silver alloy plating bath of claim 1, wherein:

said aliphatic sulfide compound of (B) is selected from the group consisting of thiobis(diethyleneglycol), represented by H—$(OCH_2CH_2)_2$—S—$(CH_2CH_2O)_2$—H;

thiobis(hexaethyleneglycol);

thiobis(pentadecaglycerol), represented by H—$(OCH_2CH(OH)CH_2)_{15}$—S—$(CH_2CH(OH)CH_2O)$—H;

thiobis(icosaethyleneglycol), represented by H—$(OCH_2CH_2)_{20}$—S—$(CH_2CH_2O)_{20}$—H;

dithiobis(triglycerol), represented by H—$(OCH_2CH(OH)CH_2)_3$—S—S—$(CH_2CH(OH)CH_2O)_3$—H;

dithiobis(decaglycerol);

1,3-propanedithiol bis(decaethyleneglycol)thioether, represented by H—$(OC_2H_4)_{10}$—S—$C_3H_6$—S—$(OC_2H_4)_{10}$—H;

1,4-butanedithiol bis(pentadecaglycerol)thioether, represented by H—$(OCH_2CH(OH)CH_2)_{15}$—S—$C_4H_8$—S—$(CH_2CH(OH)CH_2O)_{15}$—H;

1,3-dithioglycerol bis(pentaethyleneglycol)thioether, represented by H—$(OCH_2CH_2)_5$—$SCH_2CH(OH)CH_2S$—$(CH_2CH_2O)_5$—H;

1,2-ethanedithiol bis(penta(1-ethyl)ethyleneglycol)thioether, represented by H—$(OCH(C_2H_5)CH_2)_5$—$SC_2H_4S$—$(CH_2CH(C_2H_5)O)_5$—H;

1,3-dithioglycerol bis(di(1-ethyl)ethyleneglycol)thioether, represented by H—$(OCH(CH_3)CH_2)2$—$SCH_2CH(OH)CH_2S$—$(CH_2CH(CH_3)O)_2$—H;

2-mercaptoethylsulfide bis(hexatriacontaethyleneglycol), represented by H—$(OC_2H_4)_{18}$—$SC_2H_4$—$SC_2H_4$—S—$(C_2H_4O)_{18}$—H;

2-mercaptoethylsulfide bis(icosaethyleneglycol) dimethylether, represented by $CH_3$—$(OC_2H_4)_{10}$—$SC_2H_4$—$SC_2H_4$—S—$(C_2H_4O)_{10}$—$CH_3$;

2-mercaptoethylether bis(diethyleneglycol), represented by H—$(OC_2H_4)_2$—S—$CH_2CH_2OCH_2CH_2$—S—$(C_2H_2O)_2$—H;

thiodiglycerol tetra(decaethyleneglycol) ether, represented by the formula

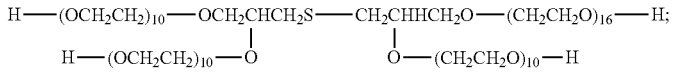

thiobis(pentacontaethyleneglycol);

4,10-dioxa-7 -thiatridecane-2,12-diol, represented by HO—$CH(CH_3)CH_2$—$OCH_2CH_2$—$SCH_2CH_2$—$OCH_2CH(CH_3)$—OH;

thiodiglycerin, represented by $HOCH_2CH(OH)CH_2$—S—$CH_2CH(OH)CH_2OH$;

thiobis(triglycerin), represented by H—$(OCH_2CH(OH)CH_2)_3$—S—$(CH_2CH(OH)CH_2O)_5$—H;

2,2' -thiodibutanol bis(octaethyleneglycol pentaglycerol) ether, represented by H—$(OCH_2CH(OH)CH_2)_5$—$(OCH_2CH_2)_8$—$OC_4H_8$—$SC_4H_8$—O—$(CH_2CH_2O)_8$—$(CH_2CH(OH)CH_2O)_5$—H;

thiobis(octaethyleneglycol) bis(2-chloroethyl)ether, represented by Cl—$CH_2CH_2CH_2$—$(OCH_2CH_2)_8$—S—$(CH_2CH_2O)_8$—$CH_2CH_2CH_2$—Cl;

thiobis(decaethyleneglycol) bis(carboxymethyl)ether;

thiobis(dodecaethyleneglycol) bis(2-nitroethyl)ether;

thiodiglycol bis(carboxymethyl)ether, represented by $HOOCCH_2OCH_2CH_2$—S—$CH_2CH_2OCH_2COOH$;

dithiodiglycol bis(carboxymethyl) ether, represented by $HOOCCH_2OCH_2CH_2$—S—S—$CH_2CH_2OCH_2COOH$;

thiobis(dodecaethyleneglycol), represented by H—$(OCH_2CH_2)_{12}$—S—$(CH_2CH_2O)_{12}$—H;

dithiobis(hentetracontaethyleneglycol), represented by H—$(OCH_2CH_2)_{41}$—S—S—$(CH_2CH_2O)_{41}$—H;

dithiobis(icosaethyleneglycol pentapropyleneglycol), represented by H—$(OC_3H_6)_S$—$(OC_2H_4)_{20}$—S—S—$(OC_2H_4)_{20}$—$(OC_3H_6)_5$—H;

diethyleneglycol monomethylthioether, represented by $CH_3$—S—$(CH_2CH_20)_2$—H;

decaglycerol mono(6-methylthiohexyl)thioether, represented by $CH_3$—S—$C_6H_{12}$—S—$(CH_2CH(OH)CH_2O)_{10}$—H;

2-mercaptoethylsulfide-omega-{(2-bromoethyl) icosaethyleneglycol}thioether-omega'-{(2-bromoethyl)hectaethyleneglycol}thioether, represented by $BrCH_2CH_2$—$(OCH_2CH_2)_{20}$—$(S—CH_2CH_2)_3$—$(OCH_2CH_2)_{100}$—$OCH_2CH_2Br$ 1,4-butanediol-omega-{(2-benzyloxy-l-methyl) ethyl}thioether-omega'-(decapropyleneglycol octacontaethyleneglycol)thioether, represented by $PhCH_2OCH_2CH(CH_3)$—S—$C_4H_8$—S—$(CH_2CH_2O)_{80}$—$(CH_2CH(CH_3)O)_{10}$—H;

dithiobis(icosaethbylelleglycol) bis(2-methylthioethyl) ether, represented by $CH_3$—S—$CH_2CH_2$—$(OCH_2CH_2)_{20}$—S—S—$(CH_2CH_2O)_{20}$—$CH_2CH_2S$—$CH_3$;

1,2-ethanediol-omega-(4-methoxybenzyl)tlrioether-omega'-(pentacontaethyleneglyco)thioether, represented by $CH_2O$-Ph-$CH_2S$—$CH_2CH_2$—$(CH_2CH_2O)_{50}$—H;

triacontaethyleneglycol mono(4-cyanobenzyl)thioether, represented by NC-Ph-$CH_2S$—$(CH_2CH_2O)_{30}$—H;

thiobis(pentadecaethyleneglycol) bisallylether, represented by $CH_2$=$CHCH_2$—$(OCH_2CH_2)_{15}$—S—$(CH_2CH_2O)_{15}$—$CH_2CH$=$CH_2$;

tricosaethyleneglycol mono(4-formylphenetyl)thioether, represented by OHC-Ph-$CH_2CH_2$—S—$(CH_2CH_2O)_{23}$—H;

pentadecaethyleneglycol mono{(acetylmethyl)thioethyl} thioether, represented by $CH_3COCH_2—S—CH_2CH_2—S—(CH_2CH_2O)_{15}—H$;

1,2-ethanediol-omega-(glycidyl)thioether-omega'-icosa-ethyleneglycol thioether, represented by the following formula

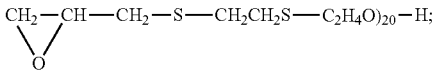

octadecaethyleneglycol bis(2-methylthioethyl)ether, represented by $CH_3—S—CH_2CH_2CO—(CH_2CH_2O)_{18}—CH_2CH_2S—CH_3$;

hexadecaethyleneglycol mono(2-methylthioethyl)thioether, represented by $CH_3—S—CH_2CH_2—S—(CH_2CH_2O)_{16}—H$;

icosaeUlyleneglycol monomethylthioether, represented by $CH_3—S—(CH_2CH_2O)_{20}—H$;

undecaethyleneglycol di(n-propyl)thioether, represented by $C_3H_7—S—(CH_2CH_2O)_{10}—CH_2CH_2S—C_3H_7$;

dodecaethyleneglycol bis(2-hydroxyethyl)thioether, represented by $HOCH_2CH_2S—(CH_2CH_2O)_{11}—CH_2CH_2S—CH_2CH_2OH$;

undecaethyleneglycol dimethylthioether;

pentatriacontaethyleneglycol mono(2-n-butyldithioethyl) dithioether, represented by $C_4H_9—S—S—CH_2CH_2—S—S—(CH_2CH_2O)_{35}—H$;

4,8,1 2-trithiapentadecane-1,2,6,10,14,1 5-hexaol, represented by $HOCH_2CH(OH)CH_2—S—CH_2CH(OH)CH_2—S—CH_2CH(OH)CH_2—S—CH_2CH(OH)CH_2OH$;

icosaglycerol mono(2-ethyithioethyl)thioether, represented by $C_2H_5—S—CH_2CH_2—S—(CH_2CH(OH)CH_2O)_{20}—H$;

triacontaethyleneglycol mono(2-methyithioethyl)thioether, represented by $CH_3—S—CH_2CH_2—S—(C_2H_4O)_{30}—H$;

dithiobis(icosaethyleneglycol)dibenzylether, represented by $Ph-CH_2—(OC_2H_4)_{20}—S—S—(C_2H_4O)_{20}—CH_2-Ph$;

tridecaethyleneglycol monomethylthioether, represented by $CH_3—S—(CH_2CH_2O)_{10}—H$;

hexadecaethyleneglycol dimethylthioether, represented by $CH_3—S—(CH_2CH_2O)_{15}—CH_2CH_2S—CH_3$ 1,2-ethanedithiol bis(icosaethyleneglycol)thioether, represented by $H—(OCH_2CH_2)_{20}—S—CH_2CH_2—S—(CH_2CH_2O)_{20}—H$; and dithio bis(pentadecaethyleneglycol), represented by $H—(OCH_2CH_2)_{15}—S—S—(CH_2CH_2O)_{15}—H$.

9. A silver and silver alloy plating bath, comprising:

(A) a soluble salt, comprising a silver salt or a mixture of a silver salt and a salt of a metal selected from the group consisting of tin, bismuth, cobalt, antimony, iridium, indium, lead, copper, iron, zinc, nickel, palladium, platinum, and gold; and (B) at least one aliphatic sulfide compound comprising a functionality selected from the group consisting of an ether oxygen atom, a 3-hydroxypropyl group, and a hydroxypropylene group, with the proviso that the aliphatic sulfide compound does not comprise a basic nitrogen atom, and said aliphatic sulfide compound of (B) is a compound represented by a general formula I $$R_e—R_a—[(X—R_b)_L—(Y—R_c)_M—(Z—R_d)_N]—R_f$$

wherein M represents an integer of 1-100;

L and N each represent an integer of 0 or 1-100,

Y represents S or S—S;

X and Z each represent O, S, or S—S, $R_a$ represents a straight chain or branched alkylene of $C_1$-$C_{12}$ or a 2-hydroxypropylene, $R_b$, $R_e$ and $R_d$ represent alkylenes of methylene, ethylene, propylene, 2-hydroxypropylene, butylene, pentylene, or hexylene; and for $X—R_b$, $Y—R_c$, and $Z—R_d$, there are no limitations on their mutual positions, and the sequence can be random, provided that when each of the bonds of $X—R_b$, $Y—R_e$, or $Z—R_d$ is to be repeated, each of the bonds can be constructed from a plurality of types of bonds, $R_e$ and $R_f$ represent (i) hydrogen; or (ii) halogen, cyano, formyl, carboxyl, acyl, nitro, hydroxy; or (iii) alkyl, alkenyl, alkynyl, aralkyl, cycloalkyl, allyl, polycyclic cycloalkyl, acetyl, or aryl; or (iv)-O-alkyl, —S-alkyl, —O-alkenyl, —O-alkynyl, —O-aralkyl, —O-cycloalkyl, —O-allyl, —O-polycyclic cycloalkyl, —O-acetyl, or —O-aryl and in (iii) and (iv), all of the functional groups can be substituted with halogen, cyano, formyl, alkoxy, carboxyl, acyl, nitro, or hydroxy, provided that at least one of X and Z represents an oxygen atom and if at least one of $R_e$, $R_f$ is a functional group of the (iv) excluding —S-alkyl or is a propyl group with a hydroxyl group substitution, or if at least one of $R_b$, $R_e$, and $R_d$ is a 2-hydroxypropylene group, neither X nor Z has to be an oxygen atom; and if L=N=0, at least one of $R_e$, $R_f$ is a functional group of (iv) excluding —S-alkyl or is a propyl group with a hydroxyl group substitution, or $R_c$ is a 2-hydroxypropylene group and if $R_b$, $R_c$, and $R_d$ are 2-hydroxypropylene groups, at the hydroxyl group at their 2-position, an oxyethylene, oxypropylene, or oxy (2-hydroxy) propylene group can be further addition polymerized.

10. The silver and silver alloy plating bath of claim 9, wherein:

said plating bath further contains at least one surface active agent, semi-brightening agent, brightening agent, smoothing agent, conductive salt, pH modifying agent, auxiliary complexing agent, suppressing complexing agent, or oxidation inhibiting agent.

* * * * *